US007042418B2

(12) United States Patent
Fujimura et al.

(10) Patent No.: US 7,042,418 B2
(45) Date of Patent: May 9, 2006

(54) CHIP ANTENNA

(75) Inventors: Munenori Fujimura, Miyazaki (JP); Hiromi Tokunaga, Miyazaki (JP); Shuichiro Yamaguchi, Miyazaki (JP); Toshiharu Noguchi, Miyazaki (JP); Kazuhiro Eguchi, Miyazaki (JP); Kenichi Kozaki, Miyazaki (JP); Shigefumi Akagi, Miyazaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 82 days.

(21) Appl. No.: 10/716,115

(22) Filed: Nov. 19, 2003

(65) Prior Publication Data

US 2004/0108967 A1 Jun. 10, 2004

(30) Foreign Application Priority Data

Nov. 27, 2002 (JP) ..... 2002-343596
Mar. 24, 2003 (JP) ..... 2003-080296
Jun. 30, 2003 (JP) ..... 2003-186823
Aug. 1, 2003 (JP) ..... 2003-284808

(51) Int. Cl.
*H01Q 1/36* (2006.01)

(52) U.S. Cl. ..... 343/895; 343/700 MS; 343/702

(58) Field of Classification Search ..... 343/895, 343/893, 700 MS, 702
See application file for complete search history.

(56) References Cited

U.S. PATENT DOCUMENTS 5,561,430 A 10/1996 Knebelkamp ..... 342/44
5,764,197 A 6/1998 Tsuru et al. ..... 343/895
5,898,413 A 4/1999 Mandai et al. ..... 343/895
5,903,242 A 5/1999 Tsuru et al. ..... 343/873
5,936,593 A 8/1999 Mandai et al. ..... 343/895
5,949,385 A 9/1999 Asakura et al. ..... 343/895
5,973,651 A 10/1999 Suesada et al. ..... 343/752
5,977,927 A 11/1999 Mandai et al. ..... 343/788
6,028,554 A * 2/2000 Mandai et al. ..... 343/700 MS
6,054,956 A 4/2000 Mandai et al. ..... 343/702
6,064,351 A 5/2000 Mandai et al. ..... 343/873
6,163,300 A 12/2000 Ishikawa et al. ..... 343/702
6,181,001 B1 1/2001 Ikefuji et al. ..... 257/679
6,288,680 B1 9/2001 Tsuru et al. ..... 343/702
6,404,394 B1 6/2002 Hill ..... 343/702
6,452,548 B1 9/2002 Nagumo et al. ..... 343/700 MS
6,486,853 B1 11/2002 Yoshinomoto et al. ..... 343/895
6,862,003 B1 * 3/2005 Yoshinomoto et al. ..... 343/895
2002/0033778 A1 3/2002 Yoshinomoto et al. ..... 343/895
2002/0063658 A1 5/2002 Washiro et al. ..... 343/700 MS
2002/0075186 A1 * 6/2002 Hamada et al. ..... 343/700 MS
2002/0118142 A1 8/2002 Wang ..... 343/895
2002/0126049 A1 9/2002 Okabe et al. ..... 343/700 MS
2002/0190906 A1 * 12/2002 Kim et al. ..... 343/702

(Continued)

FOREIGN PATENT DOCUMENTS

EP 0 831 546 A2 3/1998

(Continued)

*Primary Examiner*—Trinh Dinh
(74) *Attorney, Agent, or Firm*—Wenderoth, Lind & Ponack, L.L.P.

(57) ABSTRACT

A chip antenna includes a substrate, a plurality of helical conductors provided on the substrate, and a pair of terminals provided on the substrate. One of the plurality of helical conductors is connected electrically to one of the terminals, and another one of the helical conductors is connected electrically to the other terminal. Thus, the antenna is of a small size, yet is a single unit which alone is capable of transmitting and receiving electromagnetic waves of a plurality of frequencies.

20 Claims, 27 Drawing Sheets

U.S. PATENT DOCUMENTS

2003/0011532 A1 1/2003 Yoshinomoto et al. ..... 343/895

FOREIGN PATENT DOCUMENTS

| | | | |
|---|---|---|---|
| EP | 0-831546 | * | 3/1998 |
| EP | 0 896 384 | | 2/1999 |
| EP | 1 239 533 | * | 9/2002 |
| JP | 05-013291 | | 1/1993 |
| JP | 07-066616 | | 3/1995 |
| JP | 8-296354 | | 11/1996 |
| JP | 9-64627 | | 3/1997 |
| JP | 9-69715 | | 3/1997 |
| JP | 9-74309 | | 3/1997 |
| JP | 9-223908 | | 8/1997 |
| JP | 9-232828 | | 9/1997 |
| JP | 09-238018 | | 9/1997 |
| JP | 10-065432 | | 3/1998 |
| JP | 10-200438 | | 7/1998 |
| JP | 10-242731 | | 9/1998 |
| JP | 10-247806 | | 9/1998 |
| JP | 10-313209 | | 11/1998 |
| JP | 11-004117 | | 1/1999 |
| JP | 11-284427 | | 10/1999 |
| JP | 3011075 | | 12/1999 |
| JP | 2000-183634 | | 6/2000 |
| JP | 2001-217643 | | 8/2001 |
| JP | 2001-326522 | | 11/2001 |
| JP | 2002-033616 | | 1/2002 |
| JP | 2002-124812 | | 4/2002 |
| JP | 2002-217629 | | 8/2002 |
| JP | 2002-319810 | * | 10/2002 |
| JP | 2003-163521 | | 6/2003 |

* cited by examiner

Equivalent circuit

FIG. 27
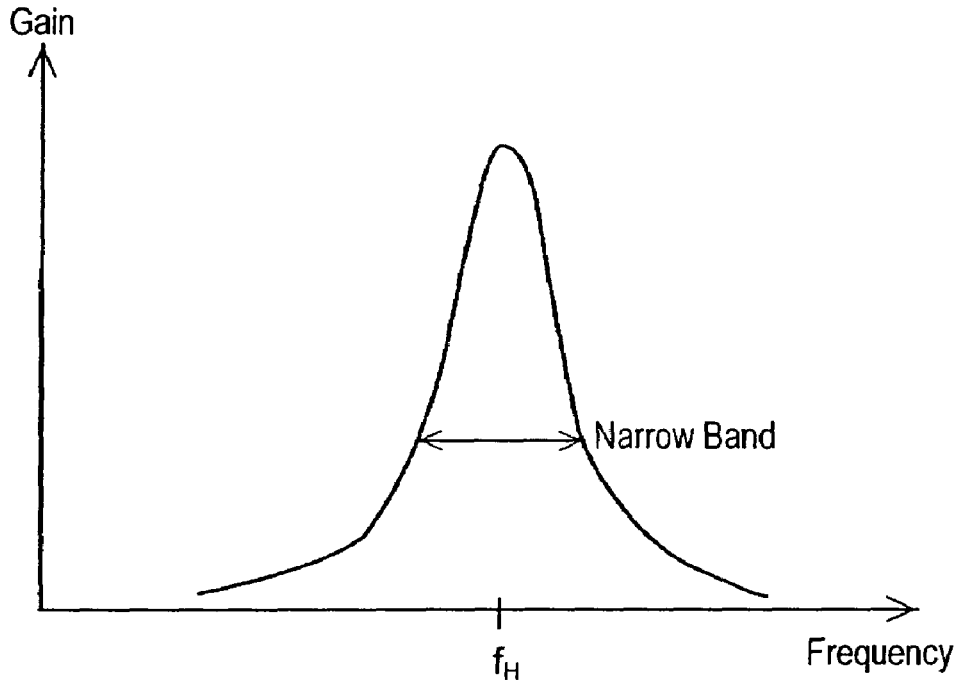
Small Capacitive Element C1
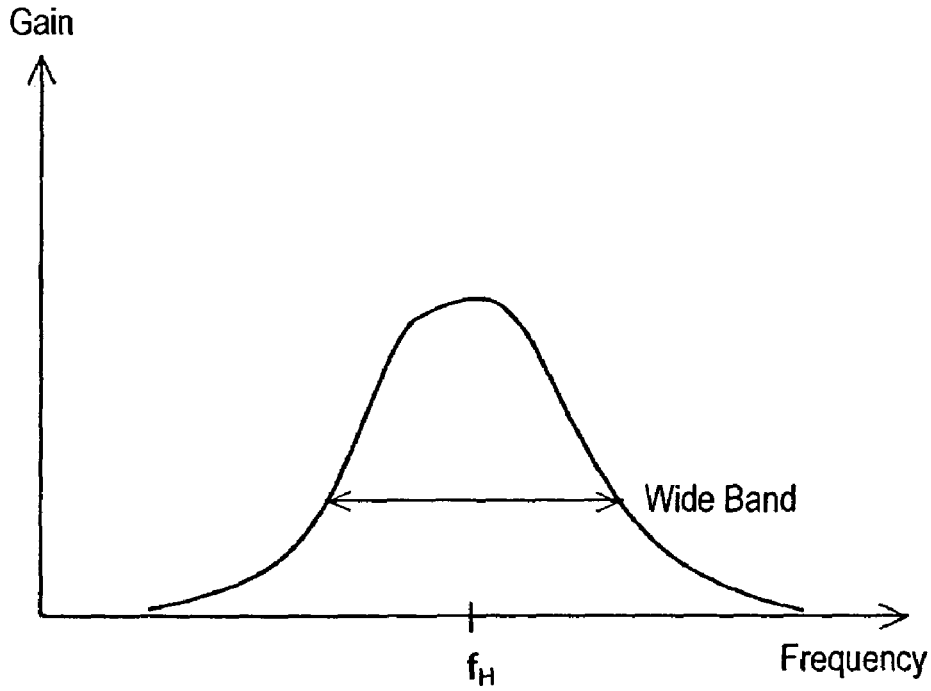
Large Capacitive Element C2

FIG. 28
Graph 1-1
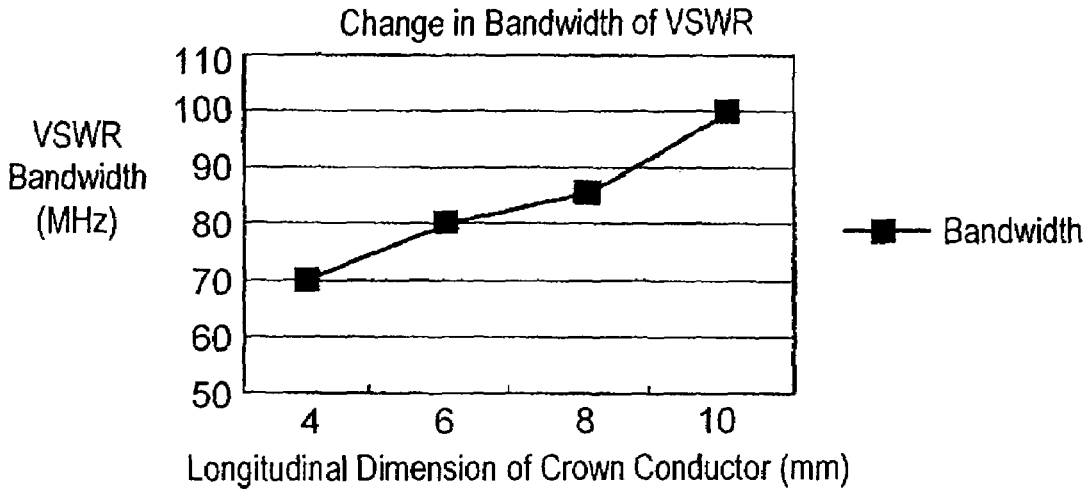
Graph 1-2
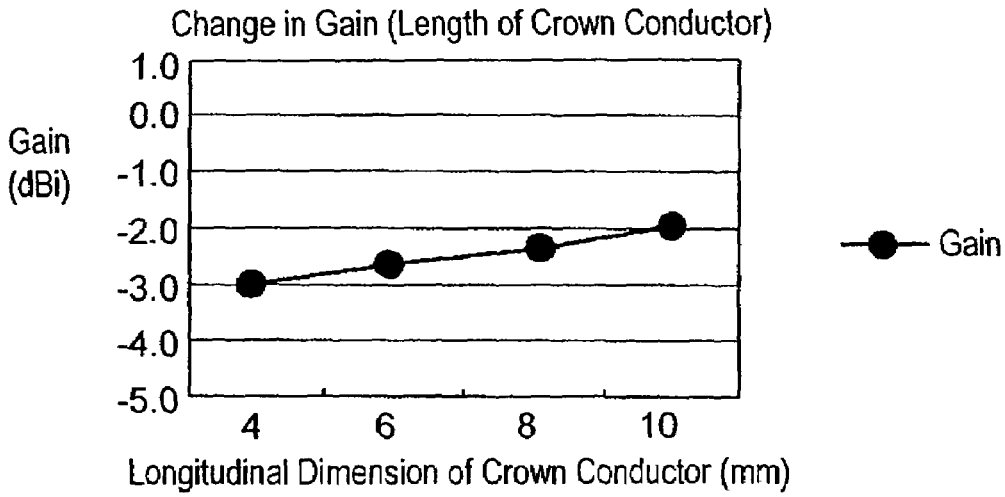

FIG. 36A A Structure Used for Experiments
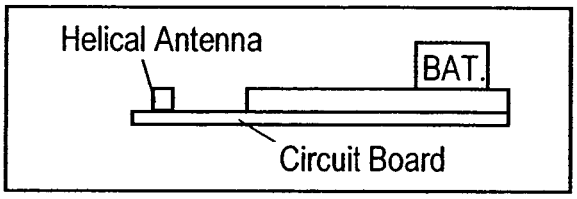
FIG. 36B Result of Experiments: VSWR Characteristic
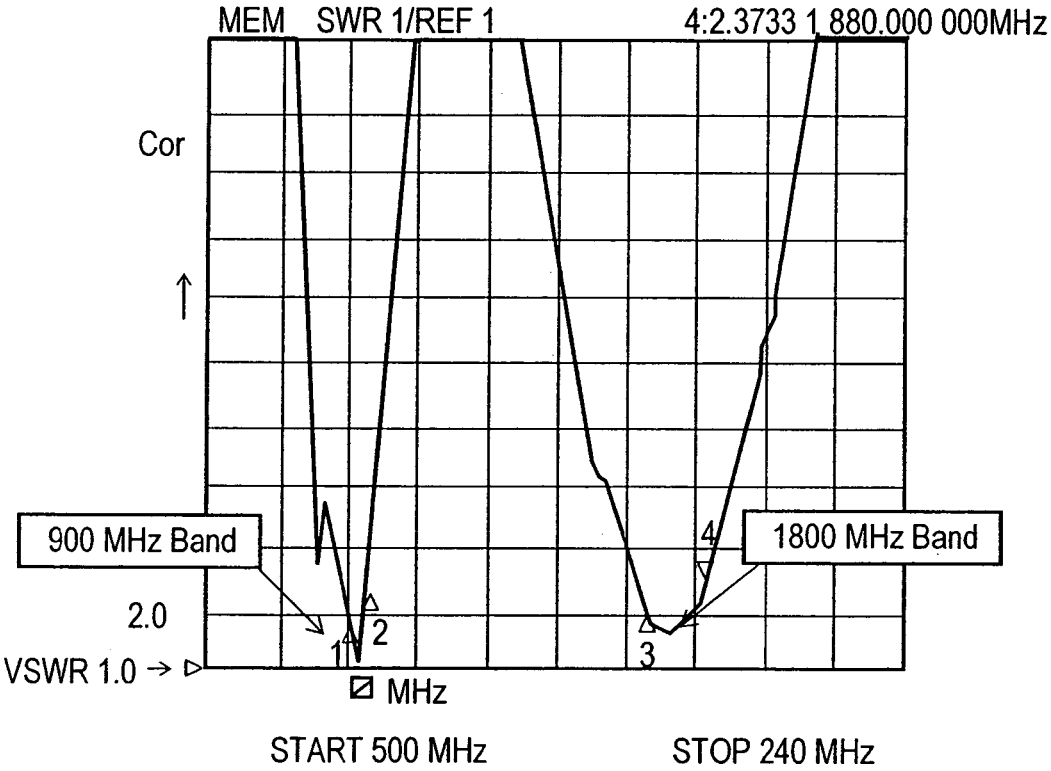
FIG. 36C Result of Experiments: Gain Characteristic
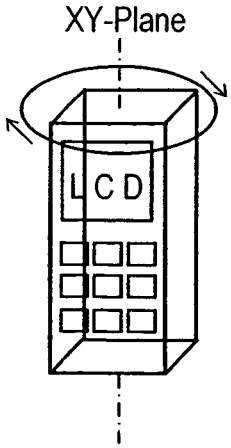
(900MHz Band)
| Gain | (dBi) |
|---|---|
| XY-Plane | -0.6 |
| YZ-Plane | -3.2 |
| ZX-Plane | -1.8 |
(1800MHz Band)
| Gain | (dBi) |
|---|---|
| XY-Plane | -4.0 |
| YZ-Plane | -4.2 |
| ZX-Plane | -2.8 |

FIG. 37A Result of Experiments: VSWR Characteristic
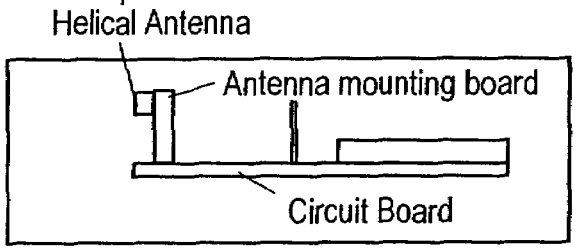
FIG. 37B Result of Experiments: VSWR Characteristic
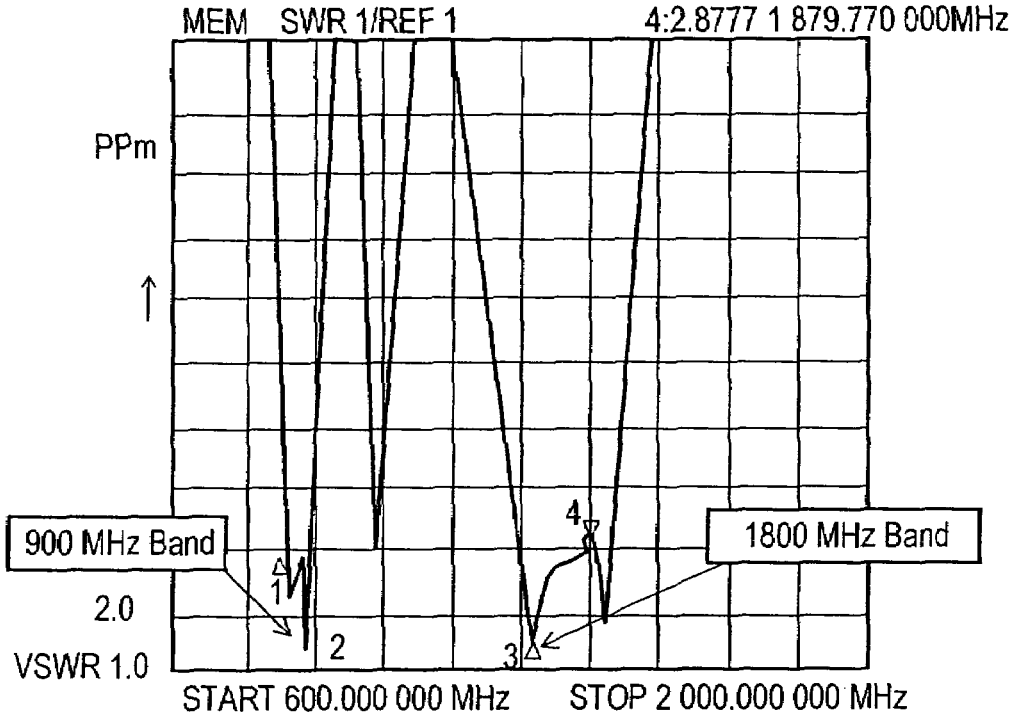
FIG. 37C Result of Experiments: Gain Characteristic
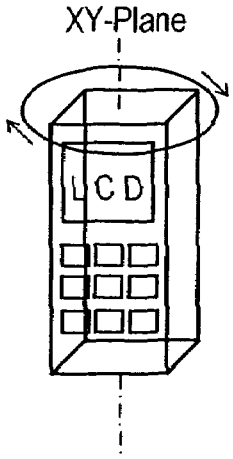
(900MHz Band)
| Gain | (dBi) |
|---|---|
| XY-Plane | -0.3 |
| YZ-Plane | -3.5 |
| ZX-Plane | -1.6 |
(1800MHz Band)
| Gain | (dBi) |
|---|---|
| XY-Plane | -4.2 |
| YZ-Plane | -4.0 |
| ZX-Plane | -3.8 |

Data (SAR Value)

| | Positions | SAR(1g[mW/g]) | | |
|---|---|---|---|---|
| | | Frequency | | |
| | | 900MHz | 1747.5MHz | 1880MHz |
| Lower Location | Cheek/Touch(90°) | 0.372 | 0.405 | 0.386 |
| | Ear/Tilt(105°) | 0.263 | 0.220 | 0.216 |
| Upper Location | Cheek/Touch(90°) | 3.56 | 2.20 | 2.10 |
| | Ear/Tilt(105°) | 2.25 | 1.36 | 1.61 |

CHIP ANTENNA

BACKGROUND OF THE INVENTION

1. Field of the Invention

The present invention relates to a chip antenna used for an electronic apparatus for performing wireless communications, such as a mobile communication device, a personal computer, and the like.

2. Background Art

Among portable terminals, such as cellular phones, there is a continuous rise in the number of devices, each equipped with a chip antenna for performing wireless communications with other electronic devices, in addition to an ordinary whip antenna or a built-in antenna used for the purpose of telephone communications.

There is also an increase in the number of handy mobile electronic devices, such as notebook type computers, capable of performing wireless data communications with a growing number of these electronic devices being equipped with chip antennas.

In addition, miniaturization of the chip antennas is strongly desired, since downsizing and energy-saving features are the essential requirements for portable terminals and notebook type computers in recent years. It is further desired that the chip antennas are capable of performing transmission and reception of various bands of frequencies because they need to be adaptable for communications according to a plurality of standards due to the recent diversification of communication services.

As an example of the above chip antennas, there is one kind which comprises a helical conductor provided on an insulating substrate of a prismal shape and terminals at both ends, wherein one of these terminals is used for a power receiving connection. (Refer to Japanese Patent Laid-open Publication, No. 2001-326522, for example.) FIG. 44 is a perspective view depicting a chip antenna of the prior art. Substrate 103 is constructed of a prism-shaped insulating material such as ceramic, for instance, and power is supplied to one of terminals 101 and 102 which are provided at opposite ends of the substrate 103. Helical conductor 104 is formed by winding a copper wire or the like, or by trimming a conductive layer plated on substrate 103. Chip antennas of this kind can be mounted easily into portable terminals and the like because they can be made very small.

There is another type of antenna, a single unit which alone is capable of transmitting and receiving signals of a plurality of frequencies. (Refer to Japanese Patent Laid-open Publication, No. 2002-33616, for example.) Use of an antenna of this kind makes it unnecessary for the portable terminal to have a plurality of antennas, since it can transmit and receive radio waves of a plurality of frequencies with the single antenna.

However, the chip antennas disclosed in the Publication, No. 2001-326522 can transmit and receive only radio waves of a single frequency, although they are very small in size.

On the other hand, the chip antennas disclosed in the Publication, No. 2002-33616 have a comparatively large construction and are not suitable for downsizing because of the complex structure requiring a number of components and power feeding elements, although they can transmit and receive radio waves of the plurality of frequencies. When consideration is given, especially to the processes up to actual mounting, it becomes apparent that downsizing is quite difficult. In particular, the chip antennas need to be adaptable for downsizing, low-profiling and energy-saving for the portable terminals, notebook computers, and the like.

Furthermore, since downsizing and energy-saving features are essential for cellular phones and notebook computers these days, it is desirable to miniaturize the antenna devices. It is also desirable that the antennas are capable of working on a wide frequency band, as the transmission capacity increases. In addition, a further increase in the operable bandwidth is necessary for the multi-career methods such as OFDM ("Orthogonal Frequency Division Multiplexing"). A small, light-weight chip antenna capable of working on a wide frequency band can be made possible by adding a conductor to a top end portion of the chip antenna to form a capacitance. (Refer to Japanese Patent Laid-open Publication, No. H10-242731, for example)

FIG. 45 is a perspective view of a chip antenna of the prior art provided with a conductor which forms a capacitance at a tip end portion of the antenna. Capacitance plate 105 functions as a load capacitance of helical conductor 104, and flattens a frequency response of an input impedance of the chip antenna, so as to widen the frequency bandwidth. The use of the crown conductor is a common practice as illustrated in Japanese Patent Laid-open Publication Nos. 2002-124812 and H10-247806.

In a structure of the chip antenna illustrated in the publication H10-242731, however, the conductor to form a capacitance needs to be attached to the tip end portion of the antenna. This gives rise to a problem that the antenna becomes too large, especially for mounting, since it requires an increased number of component elements which make the structure complex and large. It also increases a number of production processes, and makes it difficult to produce at low cost. Because it is indispensable, especially for portable terminals and notebook computers, to be small and energy-saving, miniaturization of the chip antennas is thus desirable. However, the crown conductor attached to a tip end portion of any of a rod antenna and a pattern antenna was a problem because the entire antenna device becomes too large. It is quite undesirable to use the antenna devices so large in size, especially for cellular phones and notebook type computers, since they need to be made smaller and thinner to their limits.

There is also a problem when the antenna device, such as a rod antenna and a pattern antenna, bearing a crown conductor on the tip portion is mounted to a main circuit board, that a degree of flexibility decreases in selecting the shape of the crown conductor, or an area required for mounting the antenna device increases if more flexibility is given for the shape of the crown conductor. In addition, it is necessary to solve another problem, such as a loss of gain due to a position of the antenna with respect to the main circuit board.

The antenna device is built into a notebook type computer, a portable terminal, or the like. Some of examples are disclosed in Japanese Patent Laid-open Publication Nos. 2003-163521, H10-200438, H11-4117, and so forth. When the antenna device is to be mounted to an electronic apparatus, a mounting position is determined according to specifications of the apparatus. The mounting position is normally a top end of the apparatus, if it is a portable terminal or the like.

However, another problem was that the antenna device needs a large mounting area on the circuit board, which requires the circuit board to have an extra length to that extent. When the circuit board is made longer, an enclosure of the portable terminal also needs extra length to accommodate it, thereby making it difficult to reduce the size of the portable terminal.

SUMMARY OF THE INVENTION

The invention provides a chip antenna comprising a plurality of helical conductors provided on a substrate, and a pair of terminals provided on the substrate, wherein one helical conductor of the plurality of helical conductors is connected electrically to one of the terminals, and another helical conductor is connected electrically to the other terminal.

BRIEF DESCRIPTION OF THE DRAWINGS

FIG. 27 is a pair of graphic charts showing frequency response curves in the second exemplary embodiment of this invention;

FIG. 28 is a pair of graphic representations showing a result of an experiment in the second exemplary embodiment of this invention;

FIG. 36A is a schematic illustration showing a structure of a conventional chip antenna mounted on a single circuit board which was used for an experiment;

FIG. 36B is a graphic chart showing an experimental result of VSWR of the conventional chip antenna mounted on a single circuit board;

FIG. 36C is an illustration showing an experimental result of gain characteristic of the conventional chip antenna mounted on a single circuit board;

FIG. 37A is a schematic illustration showing a structure used for an experiment in the third exemplary embodiment of this invention;

FIG. 37B is a graphic chart showing an experimental result of VSWR according to the third exemplary embodiment of this invention;

FIG. 37C is an illustration showing an experimental result of gain characteristic according to the third exemplary embodiment of this invention;

DETAILED DESCRIPTION OF THE INVENTION

Descriptions will be provided hereinafter of exemplary embodiments of the present invention with reference to the accompanying drawings.

First Exemplary Embodiment

Figure 1:
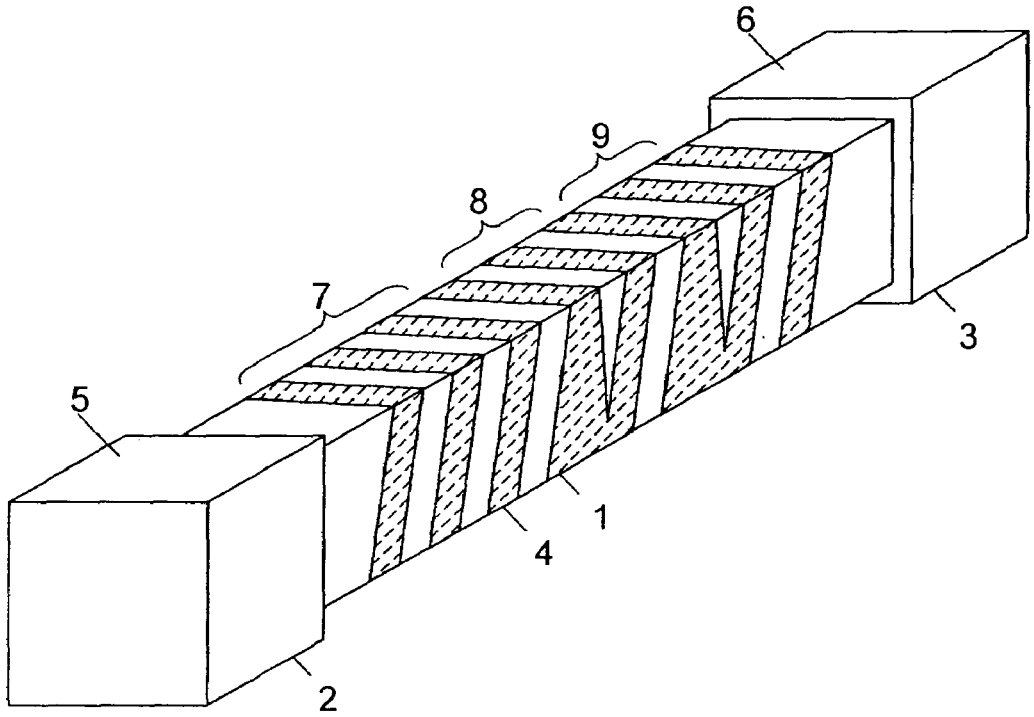
FIG. 1 is a perspective view of a chip antenna according to a first exemplary embodiment of the present invention.

FIG. 1 is a perspective view showing a chip antenna according to the first exemplary embodiment.

Substrate 1 is formed of an insulating material or a dielectric material, such as alumina or ceramic, having a principal ingredient of alumina by using press forming, extrusion forming, and the like methods. Other materials suitable as a composition of substrate 1 include ceramic materials, such as forsterite, magnesium titanate base, calcium titanate base, zirconia-tin titanate base, barium titanate base, and lead-calcium titanium base materials, and resin materials, such as epoxy resin. In consideration of strength, insulating property and ease of processing, either alumina or ceramic having a principal ingredient of alumina are used in this first exemplary embodiment. Substrate 1 is further provided on its entire exterior surfaces with an electro-conductive film comprising a single or a plural number of layers composed of a conductive material, such as copper, silver, gold, nickel, and the like.

All edges of substrate 1 are chamfered. The provision of the chamfering can prevent substrate 1 from being cracked, the electro-conductive film from lacking in thickness, and the conductor from being damaged.

End portions 2 and 3 are formed at both ends of substrate 1. Substrate 1 may have a cross section of a same size as end portions 2 and 3, or it may be stepped down so that the middle portion has a smaller sectional area than end portions 2 and 3. The provision of the stepped-down portion allows substrate 1 to maintain a space of its outer periphery from a surface of an electronic circuit board when it is mounted to the circuit board, and prevents its properties from being deteriorated. The stepped-down portion may be formed only in a part of the peripheral surface of substrate 1, or the entire surface. When the stepped-down portion is formed in the entire surface of substrate 1, it does not require special care as to which side of substrate 1 faces the circuit board when mounting substrate 1, thereby reducing the cost of mounting.

End portions 2 and 3 of substrate 1 are provided with terminals 5 and 6, respectively, which comprise electro-conductive thin films formed desirably by at least one of plating, vapor-depositioning, sputtering, silver paste coating followed by firing, and the like. One of terminals 5 or 6 serves as a power receiving point, and is connected to a power feeding section. The other one of terminals 5 or 6 is connected to an open solder land or the like, which is separated from the other circuits, to ensure strength of the mounting and to achieve emission of electromagnetic waves. In this first exemplary embodiment, although substrate 1 is provided with terminals 5 and 6 at both ends thereof, it needs only one terminal, i.e., either one of terminals 5 or 6, to serve as the power receiving point. The structure, wherein one terminal is connected to the power feeding section and the other terminal is left open, as described above, allows substrate 1 to function as an antenna to transmit and receive signals.

In addition, although terminals 5 and 6 are provided over the entire side surfaces, as well as the end surfaces, of end portions 2 and 3 in a manner to cover them completely, they may be provided only on one side among the four side surfaces. Alternatively, the terminals may be provided on all of the four side surfaces of end portions 2 and 3.

Helical conductors 7, 8 and 9 are formed on the surfaces of substrate 1, other than those of end portions 2 and 3. Spiral slits 4 in helical conductors 7, 8 and 9 are formed over the entire periphery of substrate 1. One end of helical conductor 7 is electrically connected with terminal 5, and one end of helical conductor 9 is electrically connected with terminal 6. Helical conductor 8 is placed between helical conductors 7 and 9 such that it is not electrically in connection with either of helical conductors 7 and 9. That is, individual helical conductors 7, 8 and 9 are not in electrical continuity with respect to one another. In other words, one of spiral slits 4 located between helical conductors 7 and 8 is in a continued form to cut open the conductive film on the surface of substrate 1, as shown in FIG. 1, thereby separating electrical continuity between helical conductors 7 and 8. Another one of spiral slits 4 between helical conductors 8 and 9 is also in a continued form to cut open the conductive film in the like manner. Helical conductors 8 and 9 are thus separated electrically.

In this structure, helical conductors 7 and 8 are mutually coupled capacitively, although they are not connected electrically. Helical conductors 8 and 9 are also coupled capacitively.

Description is provided first of an operation of the chip antenna having one helical conductor.

Figure 2:
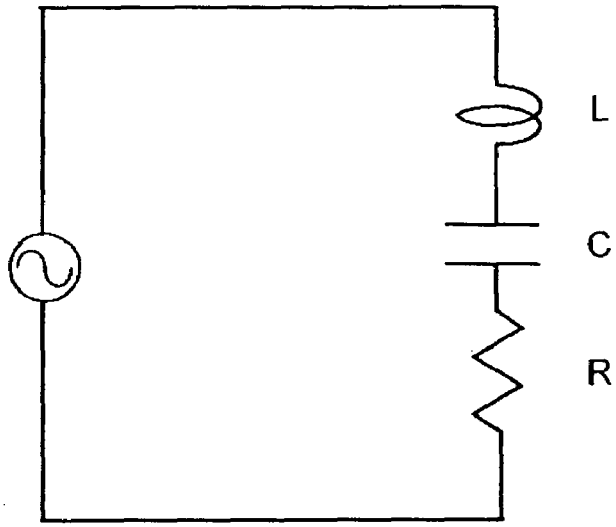
FIG. 2 is a diagram showing an equivalent circuit of a chip antenna having one helical conductor.

FIG. 2 is a diagram showing an equivalent circuit of the chip antenna having one helical conductor. Given a number of resonance conditions, a resonance frequency is expressed by Equation 1 as follows:

$$\omega_0 = 1/\sqrt{L \cdot C} \quad \text{(Equation 1)}$$

As is known from Equation 1, the antenna functions to transmit and receive electromagnetic waves of a specific frequency when it has an inductive element and a capacitive element. Values of the inductive element and the capacitive element determine the frequency of electromagnetic waves that can be transmitted and received. In other words, the inductive element of the helical conductor and the capacitive element of the substrate determine the resonance frequency $\omega_0$. This principle will explain operation of multi resonance of the chip antenna.

Figure 3A:
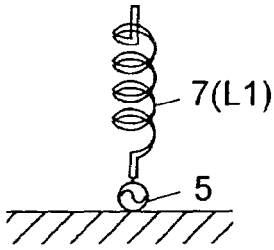
FIG. 3A is a diagram showing an equivalent circuit of a chip antenna having only helical conductor 7 formed on substrate 1.
Figure 3B:
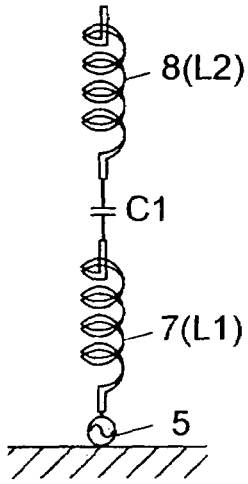
FIG. 3B is a diagram showing an equivalent circuit of another chip antenna having two helical conductors 7 and 8 formed on substrate 1.
Figure 3C:
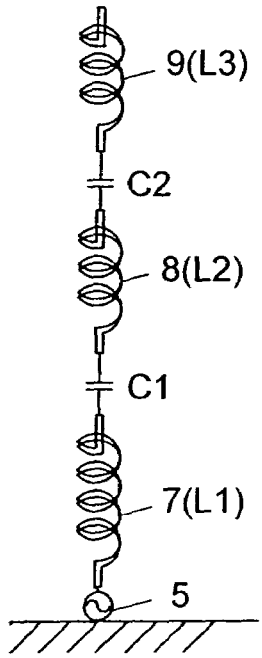
FIG. 3C is a diagram showing an equivalent circuit of still another chip antenna having three helical conductors 7, 8 and 9 formed on substrate 1.

FIG. 3A is a diagram showing an equivalent circuit of a chip antenna having only one helical conductor 7 formed on substrate 1, FIG. 3B is a diagram showing an equivalent circuit of another chip antenna having two helical conductors 7 and 8 formed on substrate 1, and FIG. 3C is a diagram showing an equivalent circuit of still another chip antenna having three helical conductors 7, 8 and 9 formed on substrate 1. The figures show examples wherein terminal 5 is used as a power receiving point. An equivalent circuit of FIG. 3C represents the chip antenna shown in FIG. 1. As shown in FIG. 3C, there are capacitance C1 formed between helical conductors 7 and 8, and capacitance C2 formed between helical conductors 8 and 9. Further, helical conductor 7 has inductive element L1, helical conductor 8 has inductive element L2, and helical conductor 9 has inductive element L3.

Here, a transmitting and receiving frequency is given by a resonance frequency determined by L1 and C1 when both C1 and C2 are assumed to be in a state of isolation. On the other hand, if only C2 is assumed to be in the state of isolation, the transmitting and receiving frequency is given by another resonance frequency determined by L1, L2, and C1 connecting between them. Furthermore, if both of C1 and C2 are assumed not being in the state of isolation, the transmitting and receiving frequency is given by another resonance frequency determined by L1, L2 and L3, and C1 and C2 in connection with them. In short, the chip antenna shown in FIG. 1 can realize three different resonances, since it includes three helical conductors within a single chip element.

This chip antenna of triple resonance is capable of transmitting and receiving signals of desired frequencies, such as near 800 MHz (e.g., a frequency for telephone communications), near 1.5 GHz (e.g., a frequency for GPS) and near 2.4 GHz (e.g., a frequency for high-speed wireless data communications).

Transmission and reception in the frequency band of 800 MHz is achieved by utilizing the chip antenna as a comparatively long antenna in which individual helical conductors 7, 8 and 9 are capacitive-coupled with capacitances C1 and C2, as shown in FIG. 3C. Transmission and reception in the frequency band of 1.5 GHz is achieved by utilizing the antenna in which helical conductors 7 and 8 are capacitive-coupled with capacitance C1, while capacitance C2 is viewed theoretically as being in a state of isolation. Transmission and reception in the frequency band of 2.4 GHz is achieved by utilizing the antenna having helical conductor 7, while both capacitances C1 and C2 are viewed theoretically as being in the state of isolation.

In addition to the above, other combinations are also considered attainable as transmitting and receiving frequencies of the triple resonance chip antenna, including:

(1) near 800 MHz (e.g., a frequency for telephone communications), near 1.5 GHz (e.g., a frequency for GPS) and near 1.8 GHz (e.g., for telephone communications in a different band from 800 MHz); and 2.4 GHz (e.g., a frequency for high-speed wireless data communications);

(2) near 800 MHz (e.g., a frequency for telephone communications), near 1.8 GHz (e.g., for telephone communications in the different band from 800 MHz), and near 2.4 GHz (e.g., a frequency for high-speed wireless data communications); and (3) near 900 MHz (a frequency for communications via GPS), near 1.8 GHz (a frequency for telephone communications through the DCS-1800 system), and near 1.9 GHz (a frequency for telephone communications through the GSM-1900 system).

In FIG. 1, though the embodied example includes three helical conductors to obtain the chip antenna of triple resonance, it is desirable that the antenna has two helical conductors in a case of double resonance, and four or more helical conductors, if four or more resonances are desired. However, the antenna element becomes too long in size if many helical conductors are connected in series. It is, thus, desirable to provide two to five helical conductors for a double resonance to a quintuple resonance, but this invention is not restricted by the above examples.

FIG. 4, FIG. 5, FIG. 6 and FIG. 7 are perspective views of chip antennas according to the first exemplary embodiment, and they show different configurations for the chip antenna of FIG. 1.

Figure 4:
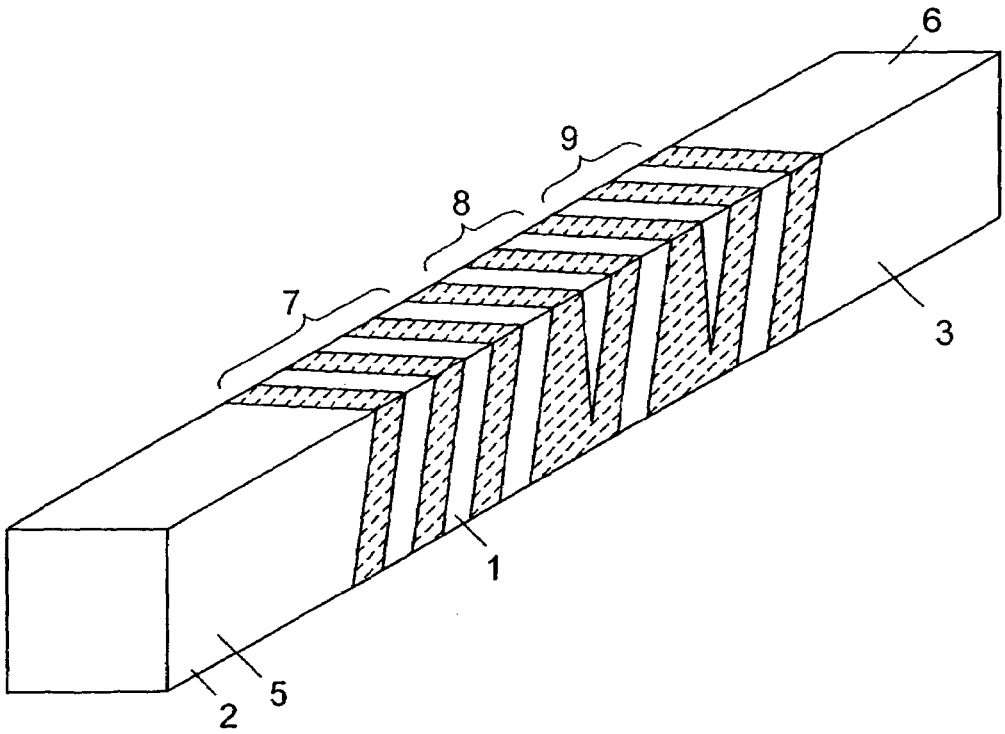
FIG. 4 is a perspective view of a chip antenna according to the first exemplary embodiment of this invention.

The chip antenna shown in FIG. 4 has a flat-surface structure, in which substrate 1 is not provided with a stepped-down portion. This considerably simplifies the structure of substrate 1, so as to substantially improve the productivity.

Although the chip antennas shown in FIG. 1 and FIG. 4 are constructed of the prismal substrates having a square cross section, they may be replaced with polygonal prisms of other shapes such as triangular prism, pentagonal prism, and so on.

Figure 5:
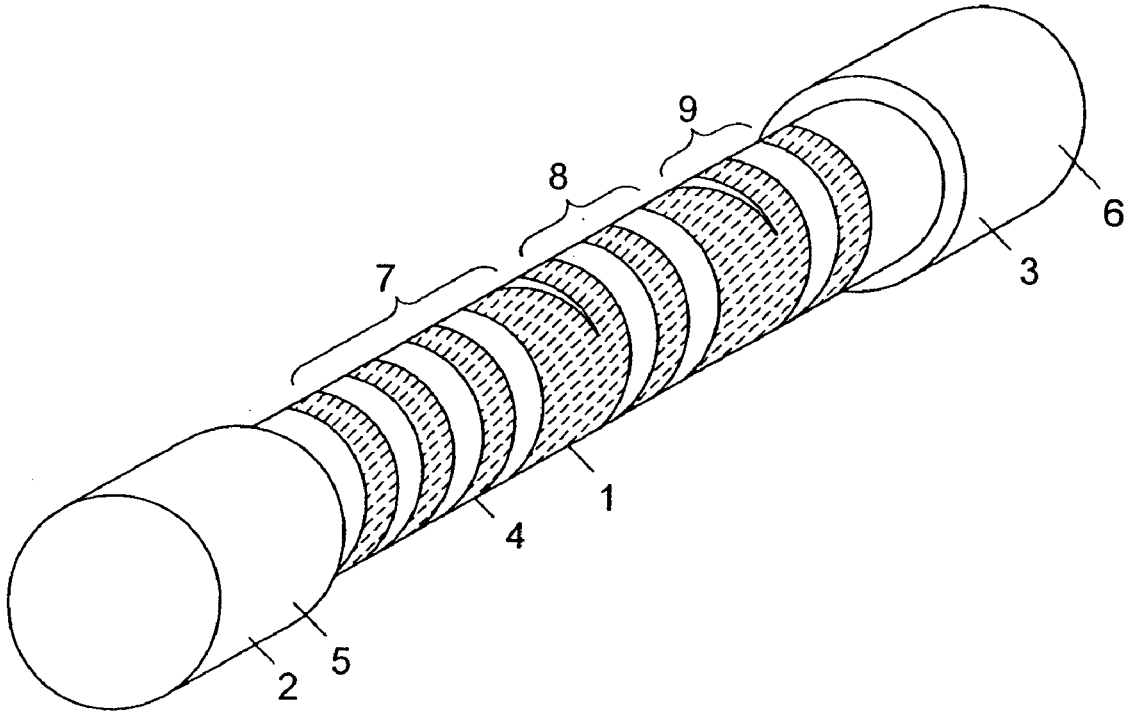
FIG. 5 is a perspective view of another chip antenna according to the first exemplary embodiment of this invention.

Also, substrate 1 and end portions 2 and 3 can be constructed of a circular cylinder having a round cross section, as shown in FIG. 5. This shape has a possibility of troubles in the mounting process such that it rolls on a circuit board as compared with the structures shown in FIG. 1 and FIG. 4. However, since the peripheral portion stepped down from both ends of substrate 1 has a circular cross section, spiral conductors can be formed very precisely by rotating it during the process of forming helical conductors 7, 8 and 9 by a laser beam or abrasion machining.

Figure 6:
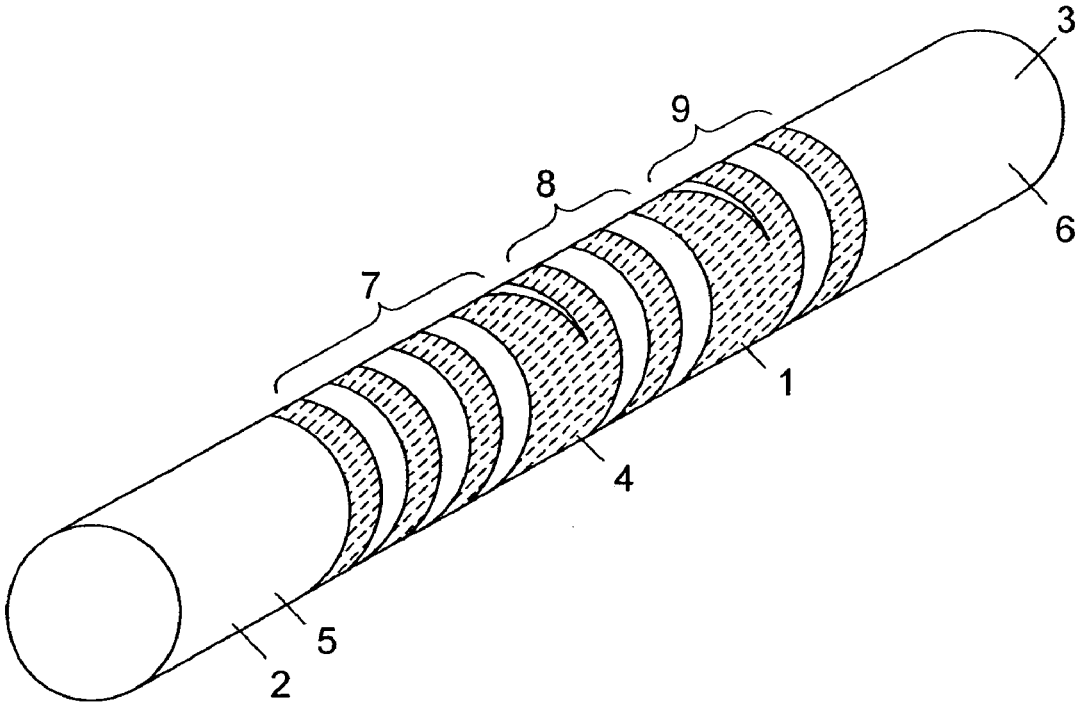
FIG. 6 is a perspective view of still another chip antenna according to the first exemplary embodiment of this invention.

Alternatively, substrate 1 and end portions 2 and 3 may be formed into a flat surface structure without the stepped-down portion, as shown in FIG. 6.

Figure 7:
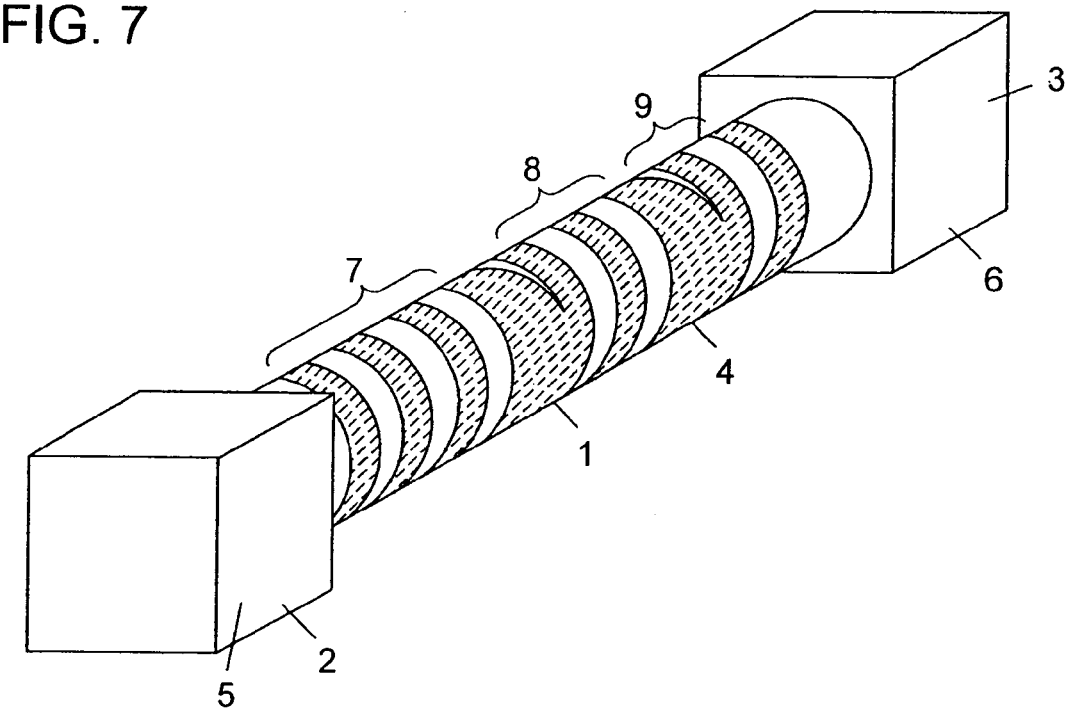
FIG. 7 is a perspective view of yet another chip antenna according to the first exemplary embodiment of this invention.

Furthermore, substrate 1 may be constructed into a combined configuration between those of FIG. 1 and FIG. 5, in which end portions 2 and 3 are square in cross section, but the center portion stepped down from end portions 2 and 3 is formed round in cross section as shown in FIG. 7. Because of end portions 2 and 3 of the polygonal cross section, this structure prevents the antenna from rolling when being mounted. In addition, the structure allows for very precise helical conductors when formed by the laser beam or abrasion machining while rolling substrate 1, since it has a circular cross section in the portion where the helical conductors are formed. The chip antenna has spiral slits 4.

Description is provided next of a chip antenna having a structure wherein helical conductors are conductively connected with one another.

Figure 8:
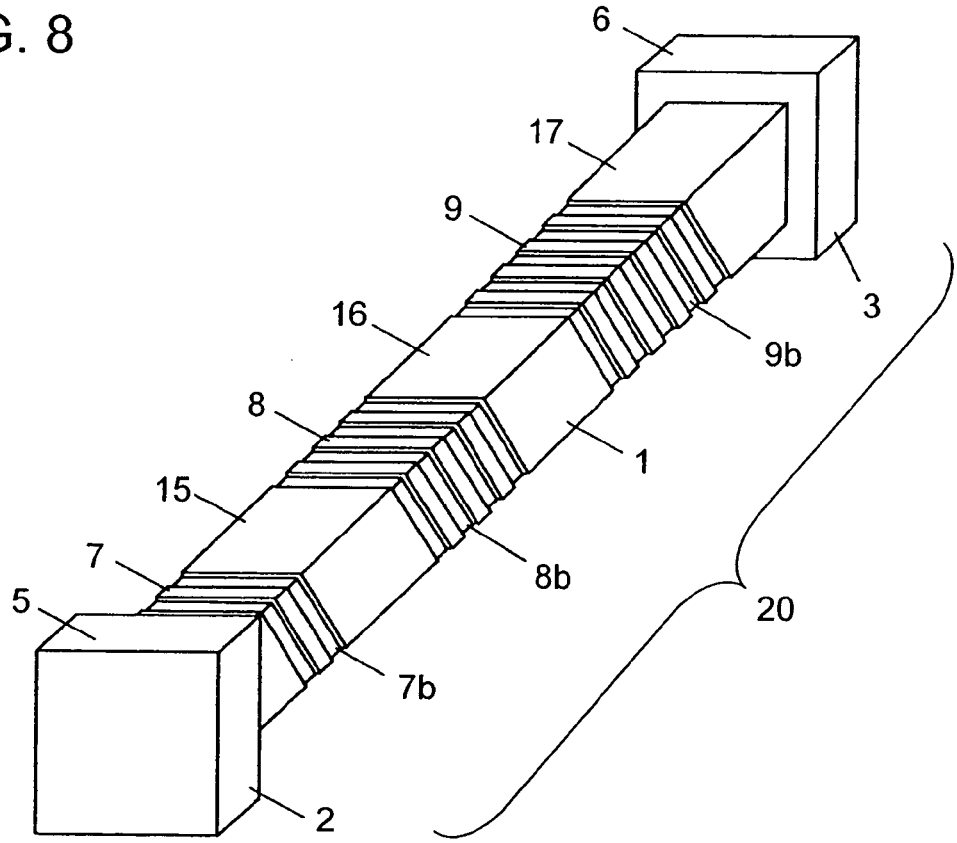
FIG. 8 is a perspective view of a chip antenna of another configuration according to the first exemplary embodiment of this invention.
Figure 9A:
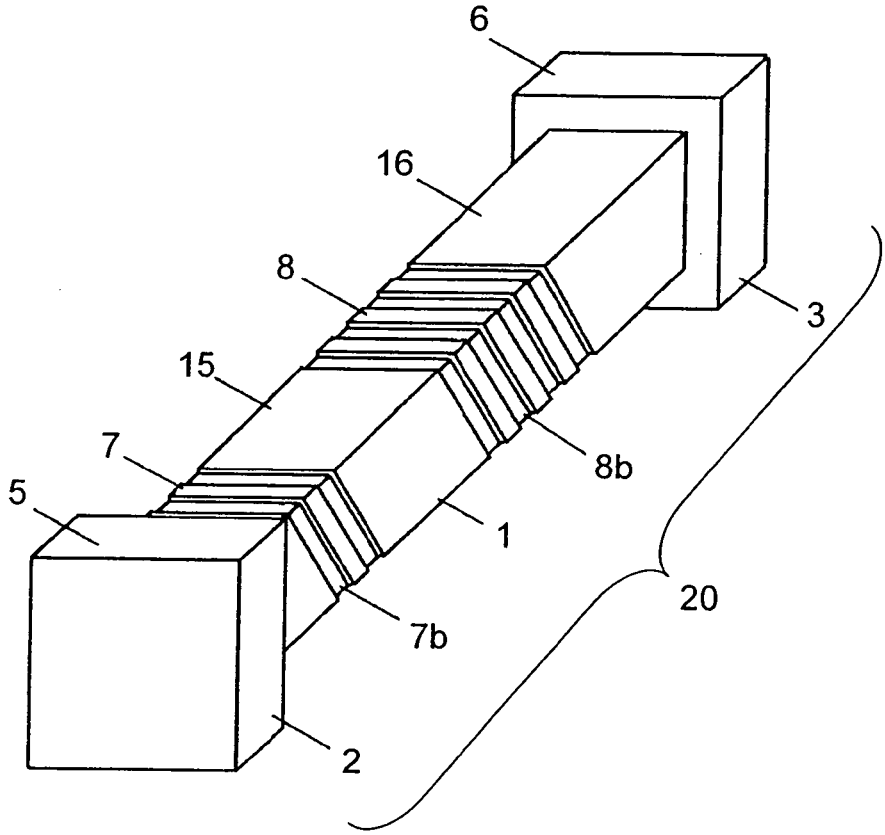
FIG. 9A is a perspective view of a chip antenna of still another configuration according to the first exemplary embodiment of this invention.
Figure 9B:
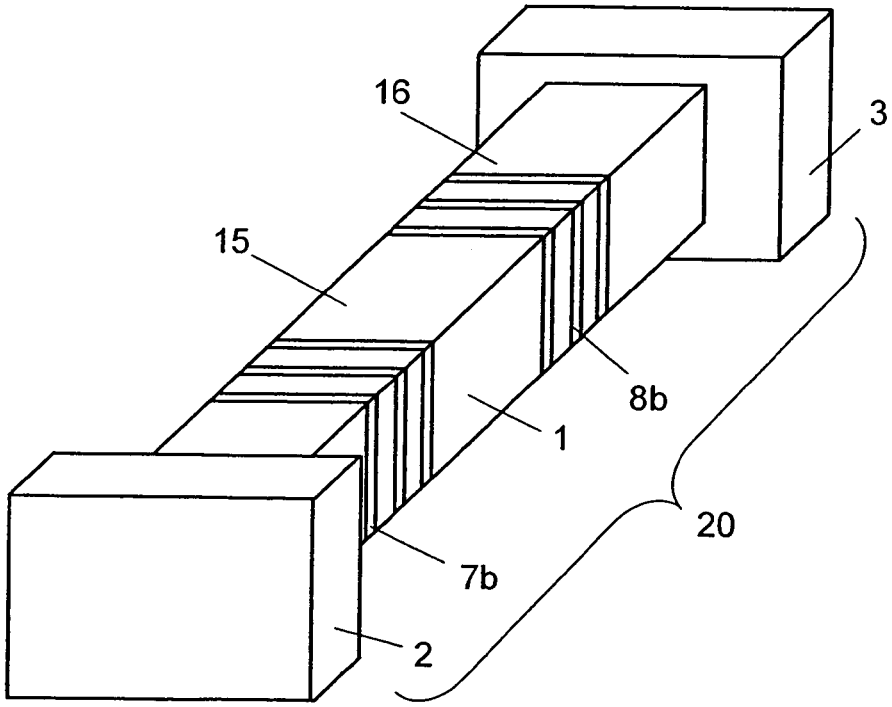
FIG. 9B is a perspective view of a chip antenna of yet another configuration according to the first exemplary embodiment of this invention.

FIG. 8, FIG. 9A and FIG. 9B are perspective views showing chip antennas of different configurations according to the first exemplary embodiment. Chip antennas 20 have any of non-helical portions 15, 16 and 17. Unlike the chip antenna shown in FIG. 1, these chip antennas are provided with helical conductors 7, 8 and 9 which are electrically connected to each other. Non-helical portions 15, 16 and 17 are areas where spirals are not formed, and they are not provided with spiral slits 7*b*, 8*b* and 9*b*. Same reference characters as in FIG. 1 are used to designate like components. A material used for substrate 1 is the same as that described with reference to FIG. 1, such as ceramic and resin material.

It is desirable that substrate 1 and end portions 2 and 3 have an oblong shape having a longer dimension in the lateral direction than the vertical direction. A reason for this is to ensure strength of the element body when substrate 1 has a length of a certain extent. The same also applies to the case of FIG. 1, in which the helical conductors are not electrically conductive.

FIG. 9B shows a perspective view of the chip antenna made into an oblong shape, which has an advantage of having strength of the element body, especially when mounting the chip antenna, and improving its durability after mounted.

FIG. 8 shows an example of the chip antenna having three helical conductors formed therein, and FIG. 9A and FIG. 9B show examples of chip antennas having two helical conductors.

Figures 10A, 10B, 10C:
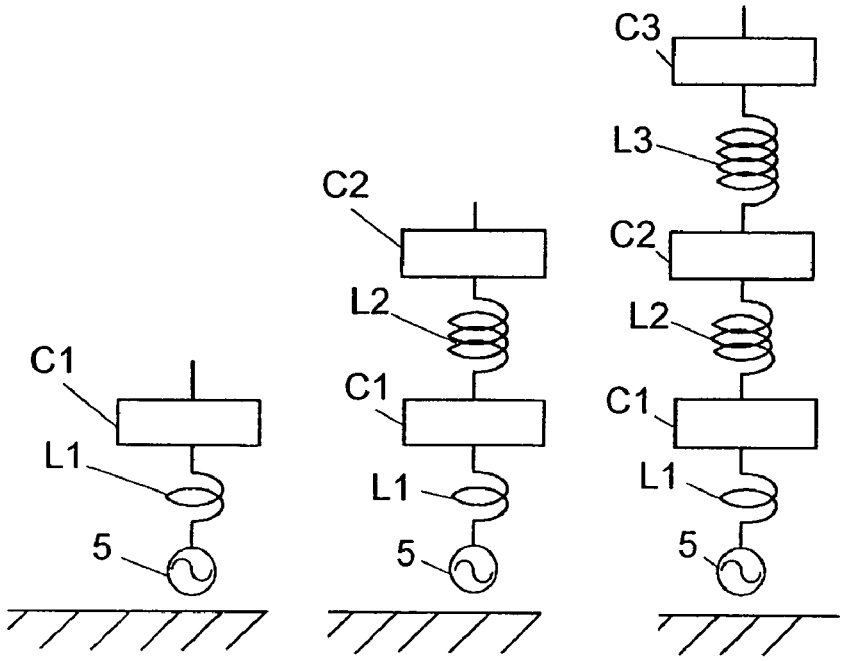
FIG. 10A, FIG. 10B and FIG. 10C are diagrams showing equivalent circuits of the chip antennas shown in FIG. 8, FIG. 9A and FIG. 9B respectively.

FIG. 10A, FIG. 10B and FIG. 10C are diagrams showing equivalent circuits of the chip antennas shown in FIG. 8, FIG. 9A and FIG. 9B. Helical conductors 7, 8 and 9 have inductive elements designated as L1, L2 and L3, respectively, non-helical portions 15, 16 and 17 have capacitive elements, and they are connected in series. FIG. 10C shows an example which has three each of helical conductors and non-helical portions as is the case of chip antenna 20 shown in FIG. 8, and FIG. 10B shows an example which has two each of helical conductors and non-helical portions like the chip antennas shown in FIG. 9A and FIG. 9B. The chip antenna shown in FIG. 8 has a triple resonance mode consisting of a resonance frequency determined by L1 and C1, another resonance frequency determined by L1, L2, C1 and C2, and another resonance frequency determined by L1, L2, L3, C1, C2 and C3. On the other hand, the chip antennas shown in FIG. 9A and FIG. 9B have a double resonance mode consisting of a resonance frequency determined by L1 and C1, and another resonance frequency determined by L1, L2, C1 and C2.

This can provide the chip antenna of a single element, yet adaptable for 900 MHz (a frequency for communications via GPS), 1.8 GHz (a frequency for communications through the DCS-1800 system) and 1.9 GHz (a frequency for communications through PCS), for example. Naturally, the chip antenna can be designed to be adaptable for only two of these frequencies, or four or more resonance frequencies. This can be achieved by providing four each of helical conductors and non-helical portions.

The maximum frequency that the antenna can transmit and receive is determined by the inductive element L1 and the capacitive element C1, and that the inductive element is proportional to a number of turns (i.e., a number of spirals) and the frequency is in inverse proportion to a square root of the inductive element. Therefore, the frequency of transmission and reception can be increased by lessening the number of turns. Accordingly, the frequency of electromagnetic waves to be transmitted and received can be increased substantially by reducing the number of turns of helical conductor 7 to be connected to terminal 5 at the power receiving side.

FIG. 11, FIG. 12, FIG. 13, FIG. 14, FIG. 15, FIG. 16 and FIG. 17 are perspective views showing chip antennas of other configurations according to the first exemplary embodiment. These chip antennas have different configurations from those shown in FIG. 8, FIG. 9A and FIG. 9B.

Figure 11:
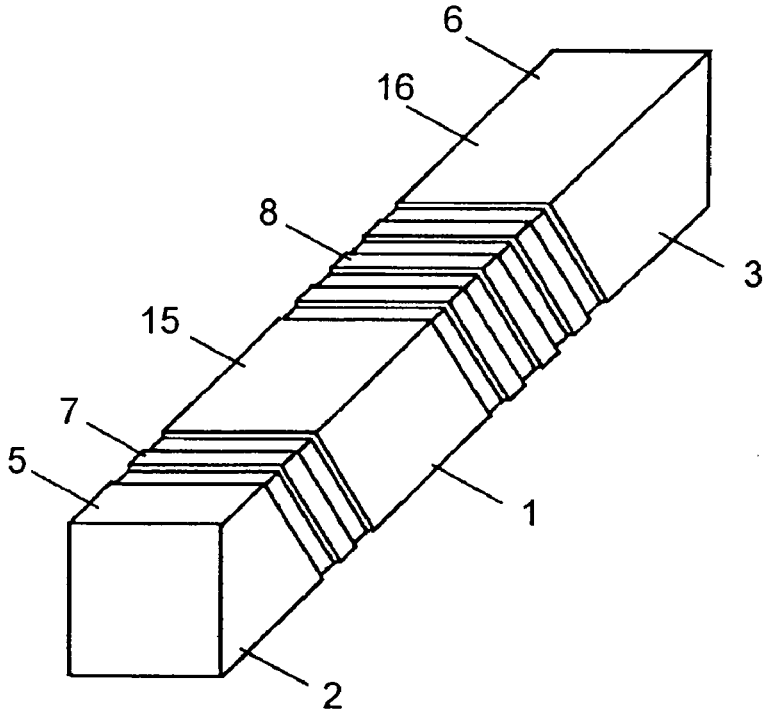
FIG. 11 is a perspective view of a chip antenna of another configuration according to the first exemplary embodiment of this invention.

FIG. 11 shows a chip antenna formed into a flat surface structure without a stepped down portion. Chip antennas 20 shown in FIG. 8, FIG. 9A and FIG. 9B have a stepped down configuration in the entire periphery of substrate 1, so that end portions 2 and 3 extend outward for improvement of the mountability. On the other hand, however, the flat surface configuration can significantly simplify the structure of substrate 1, and substantially improve the productivity.

Figure 12:
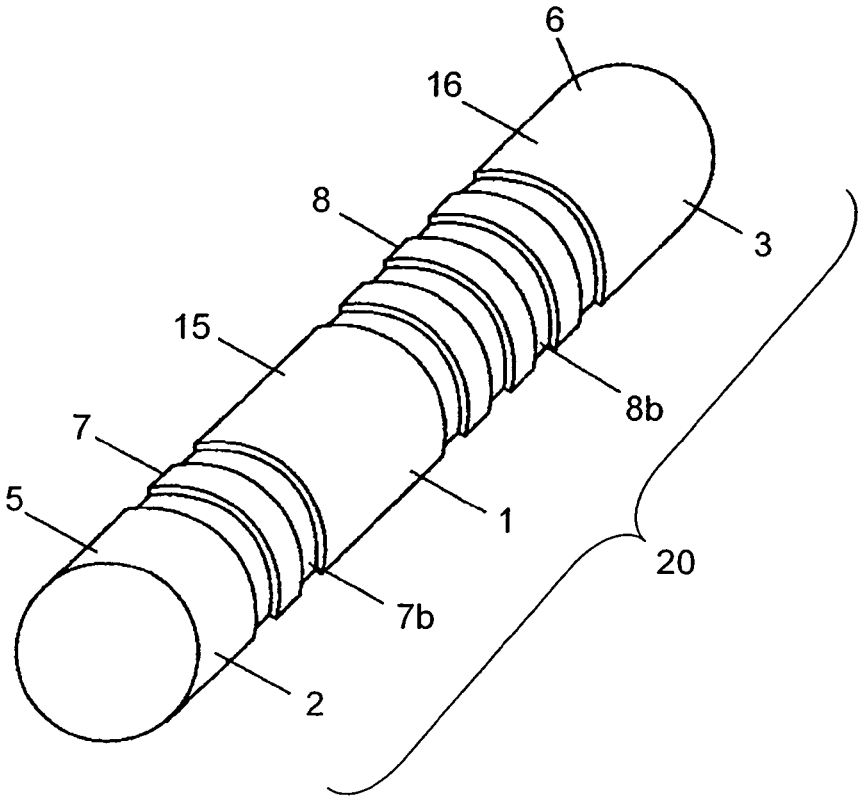
FIG. 12 is a perspective view of a chip antenna of another configuration according to the first exemplary embodiment of this invention.

FIG. 12 shows chip antenna 20 having substrate 1 and end portions 2 and 3 formed into a circular cylinder. When the shape is cylindrical, chip antenna 20 has a possibility of troubles in the mounting process such that it rolls on a circuit board as compared with the prismal structure. However, since the chip antenna 20 has a circular cross section, it has an advantage of improving efficiency and accuracy of the trimming process on substrate 1 with a laser beam and the like, so as to improve preciseness of the spiral slits formed in the helical conductors.

Figure 13:
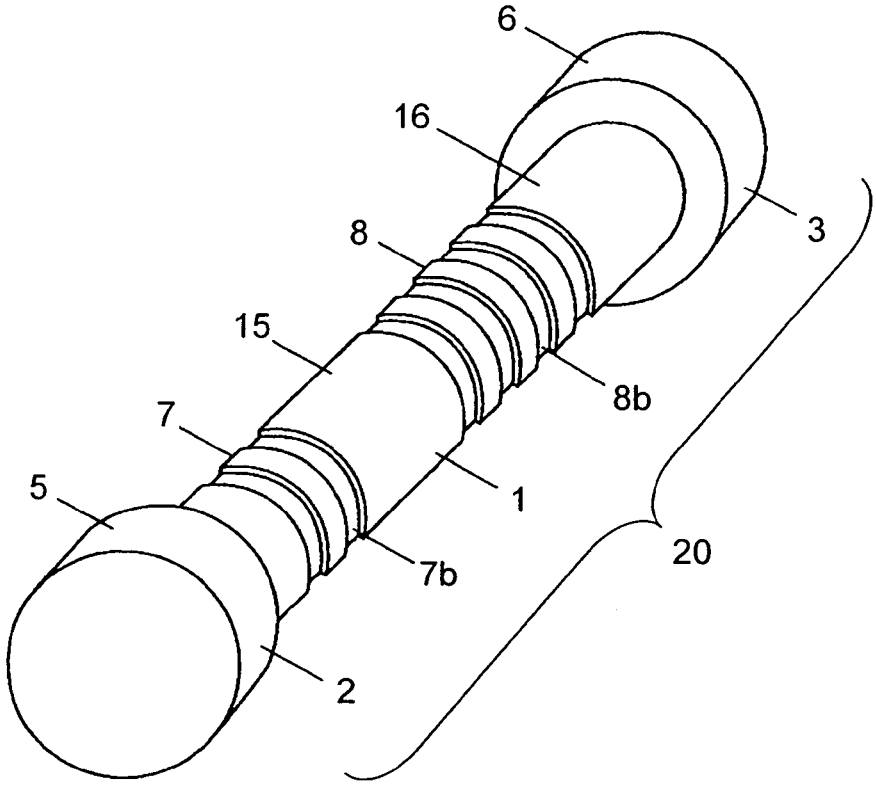
FIG. 13 is a perspective view of a chip antenna of another configuration according to the first exemplary embodiment of this invention.
Figure 14:
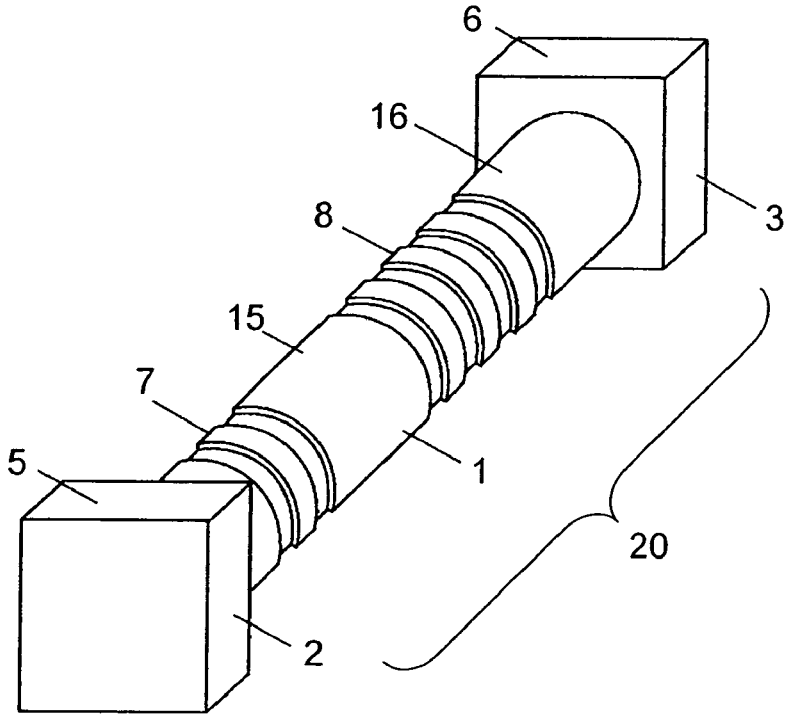
FIG. 14 is a perspective view of a chip antenna of another configuration according to the first exemplary embodiment of this invention.

Chip antenna 20 shown in FIG. 13 is provided with cylindrical end portions 2 and 3 at both ends of cylindrical substrate 1, wherein substrate 1 is stepped down so that outer peripheries of end portions 2 and 3 extend outward from that of substrate 1. Another tip antenna 20 shown in FIG. 14 is provided with end portions 2 and 3 of prismal shape at both ends of cylindrical substrate 1. These structures can provide an advantage that end portions 2 and 3 of the polygonal cross section prevent the antenna from rolling when being mounted, while the circular cross section in the center portion of substrate 1 realizes very precise helical conductors when formed by a laser beam or abrasion machining.

Figure 15:
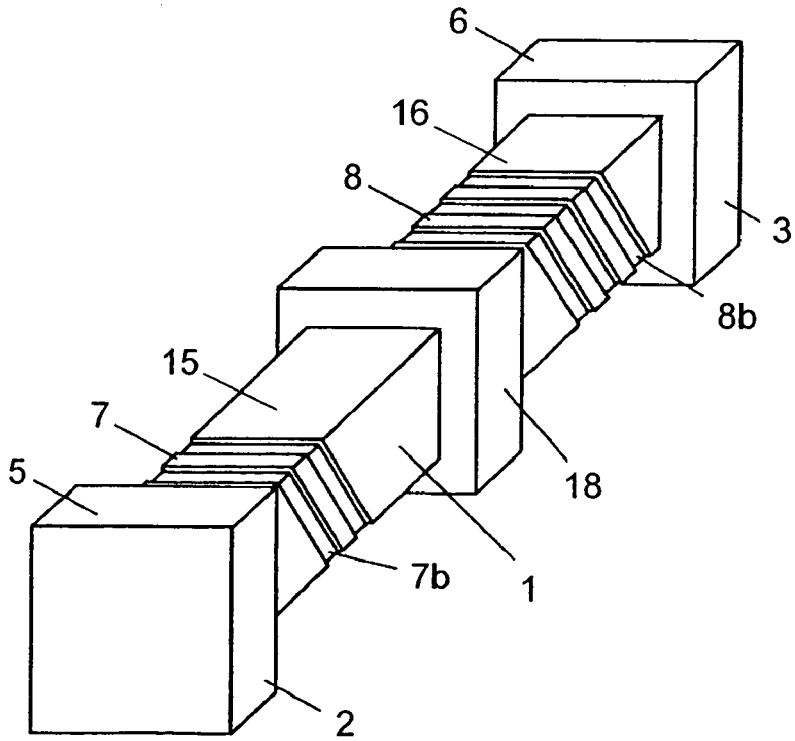
FIG. 15 is a perspective view of a chip antenna of another configuration according to the first exemplary embodiment of this invention.
Figure 16:
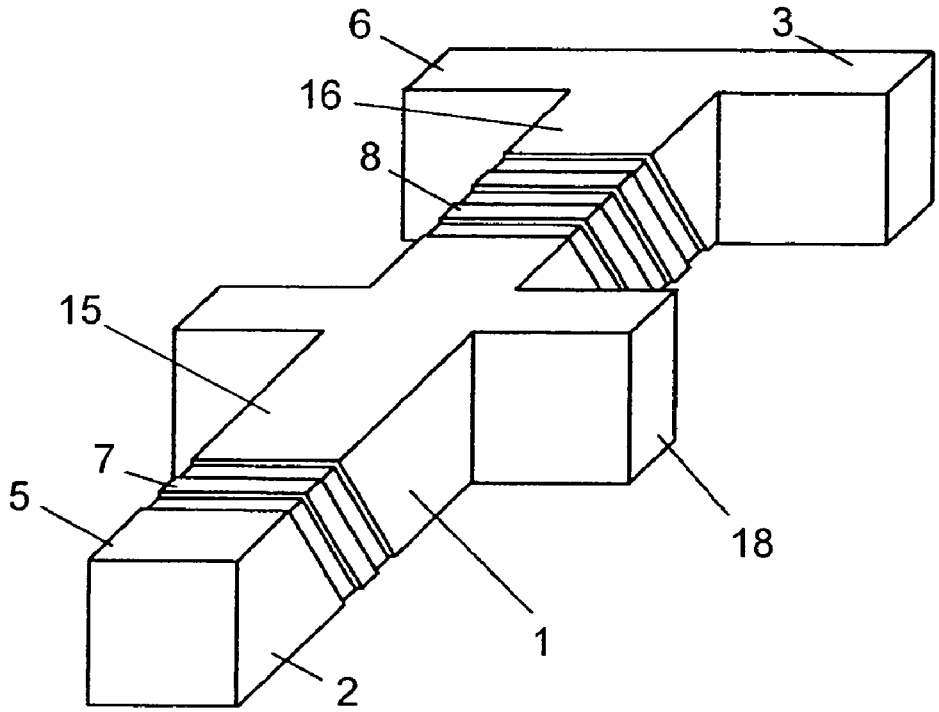
FIG. 16 is a perspective view of a chip antenna of still another configuration according to the first exemplary embodiment of this invention.
Figure 17:
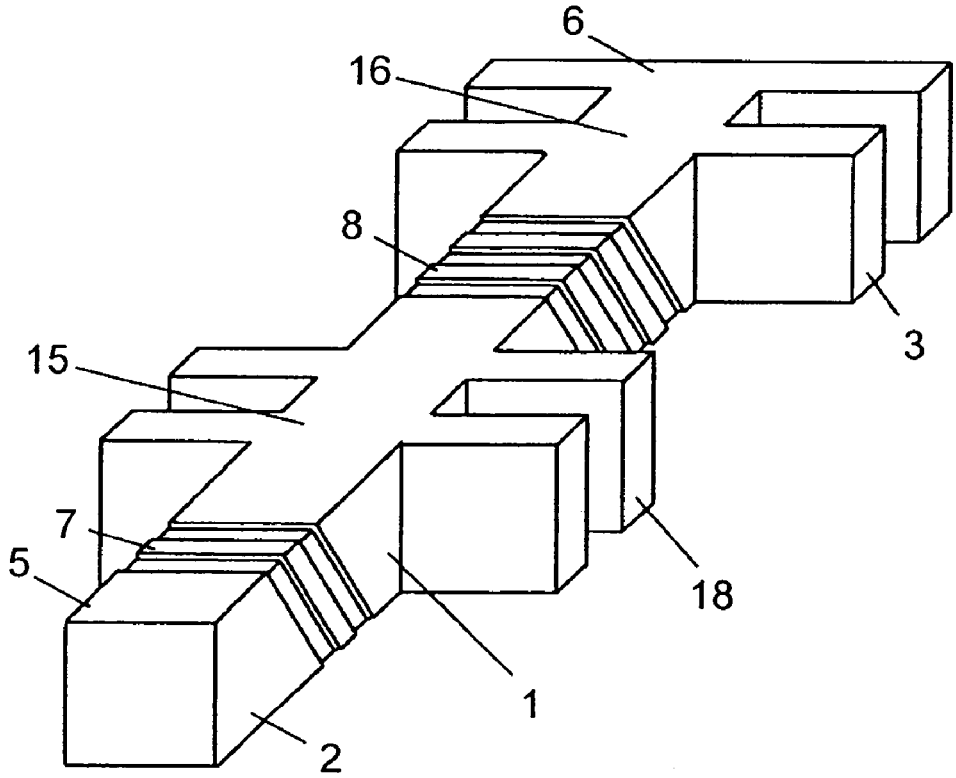
FIG. 17 is a perspective view of a chip antenna of yet another configuration according to the first exemplary embodiment of this invention.

Chip antennas 20 shown in FIG. 15, FIG. 16 and FIG. 17 have such a structure that a part of the non-helical portions has a large external dimension.

Each of these antennas is provided with protruded portion 18 having the large external dimension at the part of non-helical portion 15. Protruded portion 18 has an external shape of the same size as end portions 2 and 3. Since non-helical portions 15 and 16 have capacitive elements, their capacitances can be increased by expanding their external dimensions like that of protruded portion 18. The large capacitive elements can increase a load capacitance of chip antenna 20, thereby broadening the bandwidth. These structures also have an advantage of improving the mounting strength by connecting protruded portion 18, in addition to end portions 2 and 3, to a conductor land with solder or the like when mounting it to an electronic circuit board.

FIG. 16 and FIG. 17 show examples of protruded portions 18 of different shapes.

Protruded portion 18 shown in FIG. 16 has an external shape extending laterally, so as to increase the capacitance and further broaden the bandwidth. Since this structure provides protruded portion 18 with a larger bottom surface, it increases an area to be soldered when it is mounted to an electronic circuit board, to further improve the mounting strength. Terminals 2 and 3 may be formed into the same size as protruded portion 18, or they may be of a different size. Mounting of the antenna to the circuit board can be made easier when bottom surfaces of end portions 2 and 3 are arranged flat with that of protruded portion 18.

In the example of FIG. 17, both protruded portion 18 and end portion 3 are U-shaped to increase the surface areas and their capacitive elements. This further increases their capacitances, and broadens the frequency bandwidth. This can also reduce a length of chip antenna 20 while maintaining a sufficient amount of the capacitive element.

As an alternative to the U-shape, protruded portion 18 and end portion 3 may be formed into a comb-tooth shape to further increase their surface areas and capacitive elements.

Figure 18:
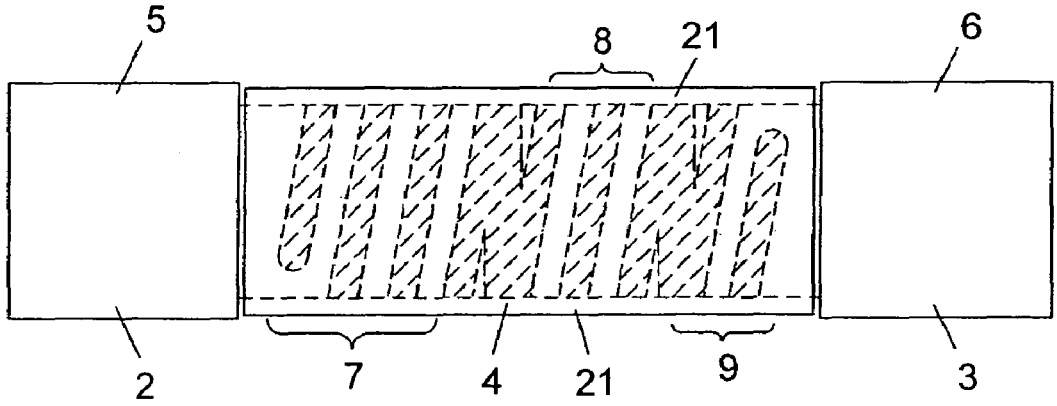
FIG. 18 is a front view of a chip antenna according to the first exemplary embodiment of this invention.
Figure 19:
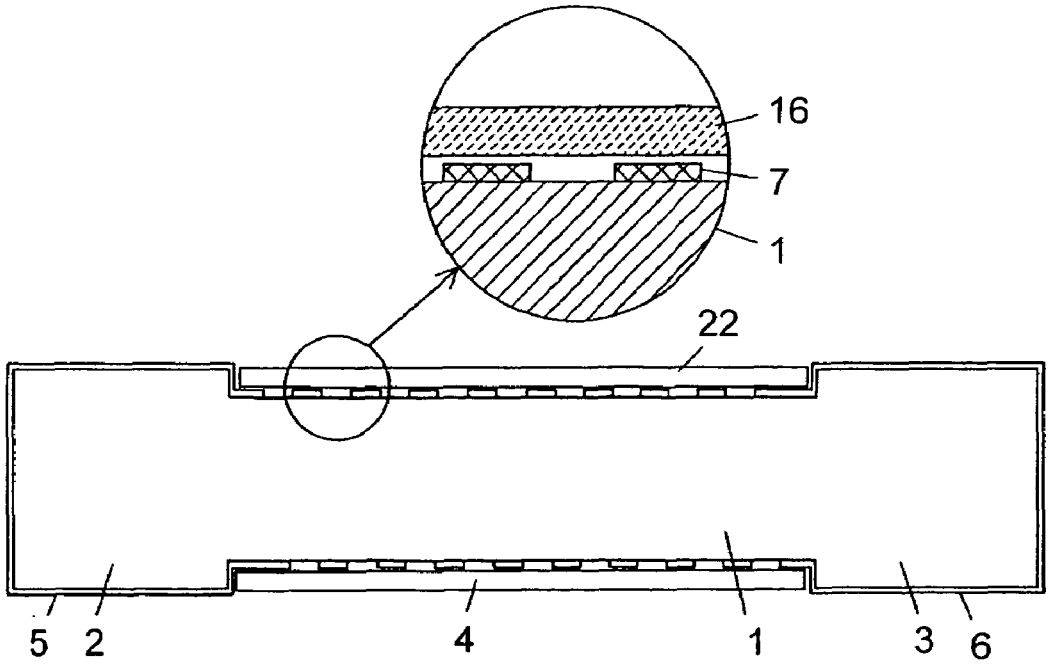
FIG. 19 is a sectional view of a chip antenna according to the first exemplary embodiment of this invention.

Referring now to FIGS. 18, 19 and 20, description is given next of a case in which the chip antenna is provided with a protective film. This structure is adaptable to any of the chip antennas shown in FIG. 1 and so forth wherein the helical conductors are not electrically conductive with each other and those shown in FIG. 8 and so forth wherein the helical conductors are electrically conductive to each other.

FIG. 18, FIG. 19 and FIG. 20 are a front view and sectional views of chip antennas, each covered with a protective film according to the first exemplary embodiment. The chip antennas comprise any of protective film 21, tube-like protective film 22, electrodeposited protective film 24, and conductive film 23.

FIG. 18 shows a structure in which protective film 21 is placed over helical conductors 7, 8 and 9. Protective film 21 improves weather resistance, and prevents deterioration of properties due to the helical conductors physically contacting with other electronic components on the circuit board. Protective film 21 needs to be provided to cover at least helical conductors 7, 8 and 9. It is suitable to use any resin material, such as epoxy, for protective film 21. Or, silicon rubber and the like are also suitable for the purpose. In addition, it is desirable that material used for protective film 21 has a low dielectric constant whenever possible. This is because the material of protective film 21 tends to flow into the slits while being coated, and it may shift the resonance point of the antenna if it has high dielectric constant. A low dielectric constant is thus desirable.

The desired antenna characteristics can be obtained, however, when a configuration of helical conductors 7, 8 and 9 and dimensions of unconnected portions therebetween is designed beforehand, taking into consideration the dielectric constant and the like of protective film 21.

It is also desirable that protective film 21 is formed within the stepped-down portion of substrate 1, so that its surface remains level with or lower than the surfaces of end portions 2 and 3. Protective film 21 formed in this manner does not cause a contact failure between any surface of terminals 5 and 6 and the circuit board when the chip antenna is mounted.

Protective film 21 can be formed by coating or wrapping resin material in a form of paste or the like.

FIG. 19 shows a protective film formed by using a tube-like protective film 22.

Use of tube-like protective film 22 can effectively protect the helical conductors without altering their characteristics. That is, the tube-like protective film 22 is set on substrate 1 in a manner to cover the individual helical conductors 7, 8 and 9, so that no other material can flow into the slits and spaces between the helical conductors in the process of forming the protective film. Accordingly, it is quite unlikely that tube-like protective film 22 will alter the characteristics. For the tube-like protective film 22, it is desirable to choose one made of plastic resin with a thermally shrinkable property. Tube-like protective film 22 is placed to cover around substrate 1 and subjected to a heating process which shrinks the tube. This can securely fix tube-like protective film 22 in place over the substrate 1.

Figure 20A:
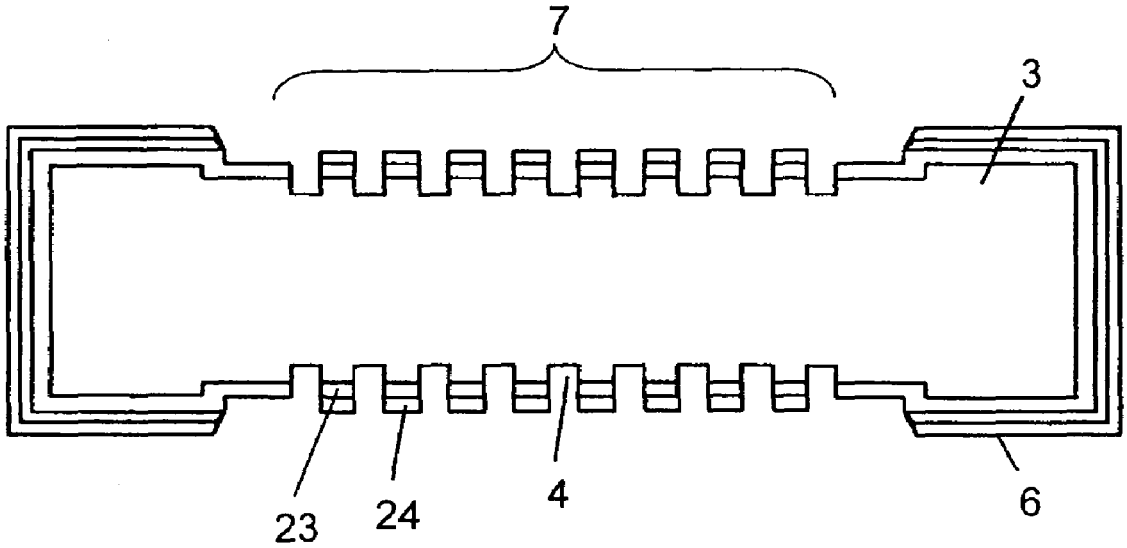
FIG. 20A, FIG. 20B and FIG. 20C are sectional views of the chip antenna according to the first exemplary embodiment of this invention.
Figure 20B:
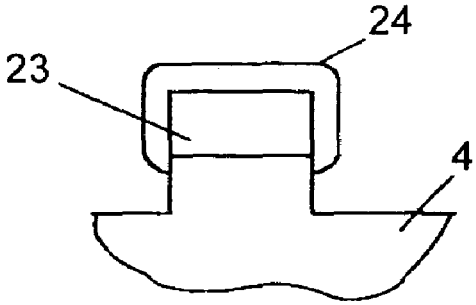
Figure 20C:
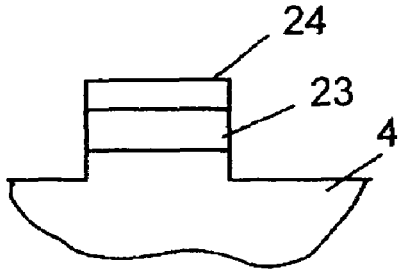

FIG. 20A, FIG. 20B and FIG. 20C show another example in which electro-deposited protective film 24 is provided over the spirally formed conductive films 23 of the helical conductors, as another form of the protective film. Unlike the protective films made of resin materials, such as protective film 21 and tube-like protective film 22, it is desirable to use a metallic material for this electro-deposited protective film 24.

Electro-deposited protective film 24 differs from the cases shown in FIG. 18 and FIG. 19, in that it protects only the spirally formed conductive films left on the helical conductors. In other words, it does not cover spiral slits 4, but only conductive films 23 formed on the spiral portions. Electro-deposited protective film 24 is composed of a metallic material superior in the weather resistance, and more specifically, it is made of at least one selected among a group of such materials as gold, platinum, palladium, silver, tungsten, titanium and nickel, or an alloy composed of one material selected from the above group and another element not listed in the above material group. It is especially preferable to use gold or gold alloy in view of the cost and weather resistant property. Electro-deposited protective film 24 is formed by using such methods as plating, sputtering and vapor-depositing.

Configurations shown in FIG. 20B and FIG. 20C are thought to be adoptable as shapes of electro-deposited protective film 24. In other words, the configuration shown in FIG. 20B covers the entire surface of conductive film 23 nearly completely with electro-deposited protective film 24, thereby protecting conductive film 23 reliably. Another configuration shown in FIG. 20C covers only the outer surface of conductive film 23 with electro-deposited protective film 24, leaving the side surfaces of the spirally formed conductive film 23. Although this configuration gives a lower level of weather resistance to a certain extent as compared with that of FIG. 20B, this is still practical for its purpose since the exposed surfaces are substantially small as they correspond to the thickness of conductive film 23.

The configuration shown in FIG. 20B can be constructed by forming conductive film 23 first on a portion or the entire surface of substrate 1, trimming off spiral slits 4 next, and forming protective film 24 thereafter by electro-deposition or the like method.

The configuration shown in FIG. 20C can be constructed by forming conductive film 23 first on a portion of or the entire surface of substrate 1, forming protective film 24 on top of conductive film 23, and trimming off spiral slits 4 thereafter. This process produces electro-deposited protective film 24 on only the outer surface of conductive film 23.

It is desirable that electro-deposited protective film 24 has a thickness between 0.05 μm and 7 μm (more preferably, between 0.1 μm and 5 μm). It does not provide for sufficient weather resistance if the film thickness is less than 0.05 μm. If the film thickness is greater than 7 μm, on the other hand, it increases a possibility of short-circuiting between the adjacent spiral conductive films 23, and gives rise to a problem of cost increase despite of no obvious improvement in the weather resistant property.

To ensure stable characteristics as an antenna without degradation, it is desirable that electro-deposited protective film 24 maintains a low electrical resistance. Taking this into account, it is desirable to use one of gold, gold alloy, platinum, platinum alloy, palladium and palladium alloy (i.e., metals in the platinum group and platinum group alloy).

Besides, any such metal as tungsten, titanium and nickel forms an oxide compound on its surface, and formation of an oxide layer provides a stable weather resistance. Although these metals may develop small variations in the antenna characteristics after a long time of use, they are also useful for the antennas where appropriate, depending on the specifications of use. To solve the above problems, an oxide layer is formed beforehand on the surface of electro-deposited protective film 24 so as to adjust the characteristics at the time of manufacturing, thereby preventing after-use degradation of the characteristics.

The protective films formed in the above manner make it possible for the chip antennas to avoid the problems, such as damage and changes in the characteristics from taking place, when mounting and during use.

Description is provided next of formation of helical conductors 7, 8 and 9.

Figure 21:
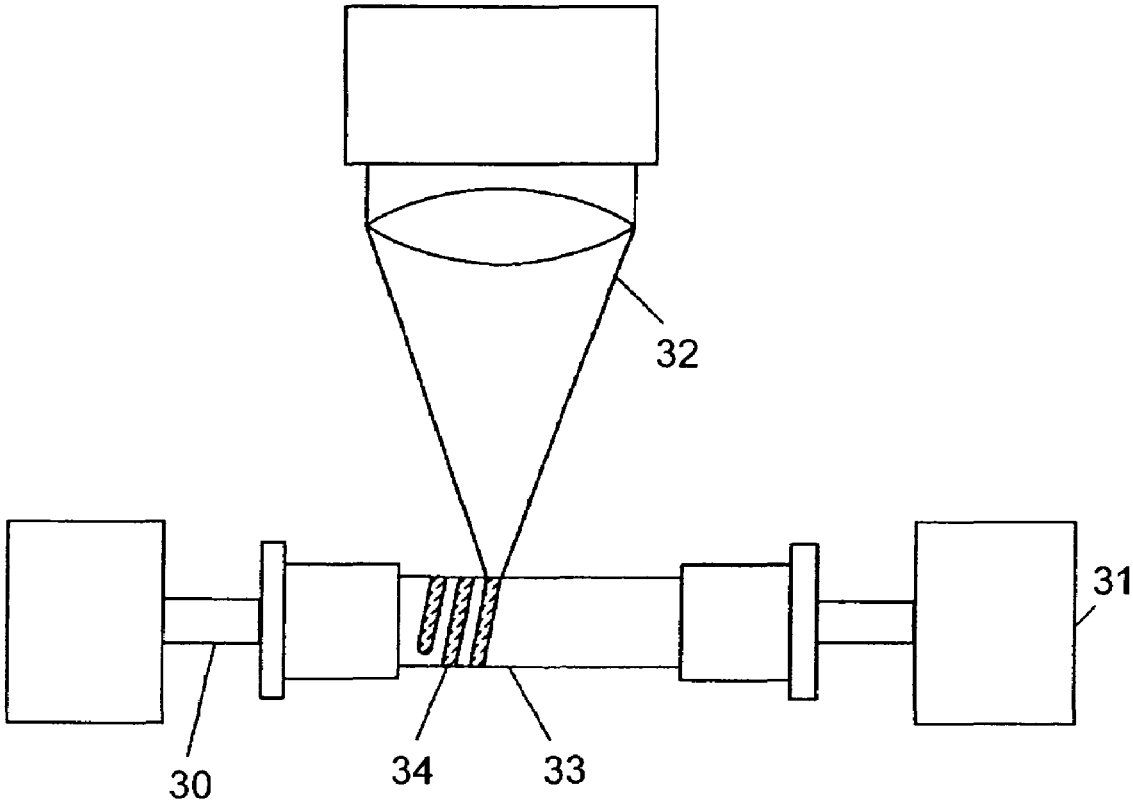
FIG. 21 is a schematic illustration showing a method of processing a helical conductor according to the first exemplary embodiment of this invention.

FIG. 21 is an illustration depicting a method of forming a helical conductor according to the first exemplary embodiment. The method here shows rotary support 30, motor 31, laser irradiator 32, conductive-film-covered substrate 33, and trimmed slit 34.

In this example, conductive-film-covered substrate 33 is prepared by forming one or plural layers of conductive films composed of conductive materials, such as copper, silver, gold and nickel, on the entire surface of substrate 1, and an apparatus such as shown in FIG. 21 is used for the process of laser machining. In FIG. 21, conductive-film-covered substrate 33 is set to rotary support 30 and turned by motor 31, and helically trimmed slit 34 is then cut by irradiating a laser light beam from laser irradiator 32 to conductive-film-covered substrate 33 while shifting at least one of laser irradiator 32 and rotary support 30 in one direction. The conductive film is completely stripped off from slit 34 during this process, and helically shaped conductive films are left after the trimmed slit 34 is formed. The helically shaped conductive films left here serve as helical conductors 7, 8 and 9.

When making a chip antenna having un-continuous type helical conductors, such as the one shown in FIG. 1, an un-connected portion between helical conductors 7 and 8 is formed by interrupting a relative shift-movement of laser irradiator 32 with respect to conductive-film-covered substrate 33, to trim an annular slit around substrate 33. Or, the slit may be formed by slowing down the relative shift-movement between laser irradiator 32 and conductive-film-covered substrate 33 to such an extent that two areas of laser irradiation overlap (i.e., two adjacent slits are formed in an overlapping manner).

Another type of chip antenna having a plurality of electrically connected helical conductors, such as the one shown in FIG. 8, can be formed by temporarily suspending the laser irradiation and shifting conductive-film-covered substrate 33 after forming the first helical conductor with the laser irradiation, and restarting the laser irradiation to form the next helical conductor at the shifted position. This method makes the non-helical portion between adjoining helical conductors.

In the above exemplary embodiment, although laser irradiation was shown as the method of forming the individual helical conductors, other trimming means are also useful such as an abrasive wheel machining.

In the method described above, the conductive film also covers surfaces of end portions 2 and 3, since the conductive film is formed entirely over substrate 1. Portions of the conductive film covering end portions 2 and 3 can be thus used as terminals 5 and 6. Alternatively, the conductive films on end portions 2 and 3 may be further covered with at least one of corrosion resistant film made of a material such as nickel (solder-erosion preventing film), and bonding film made of tin or lead free solder consisting of tin alloy mixed with other metal (not including lead) to form terminals 5 and 6. Or, individual helical conductors may be made from a conductive film formed only in the center portion 4 of substrate 1, and another set of conductors are formed by coating and firing conductive paste, such as silver paste, on end portions 2 and 3. These fired conductors can serve as terminals 5 and 6 by connecting two ends of the conductive film with the respective sides of the conductors. The fired conductors may also be covered further with any of the corrosion resistant film and the bonding film described above.

Helical conductors 7, 8 and 9 may be constructed by winding filament wires of conductive material, as another example. When this is the case, the filament wires are fixed to substrate 1 by using adhesive or by means of resin molding. Or, substrate 1 may be provided with a plurality of isolated conductive films, and one end of filament-formed helical conductor 7 is connected to terminal 5, the other end is connected to the first one of these isolated conductive films, one end of helical conductor 8 to the second conductive film isolated from the first one, the other end to the third conductive film isolated from any of the above-said conductive films, one end of helical conductor 9 to the fourth conductive film isolated from any of the above-said conductive films, and another end to terminal 6. This structure has an advantage of securing the individual helical conductors easily to substrate 1 by way of bonding the wire ends of helical conductors to the conductive films by thermal-compression bonding, ultrasonic welding, and the like method without using adhesive material.

Thickness, length, etc. of the individual helical conductors can be obtained from a result of appropriate experiments according to the characteristics of devices used. Dimensions of the spaces for un-connected portions among the individual helical conductors can be obtained also from appropriate experiments and the like.

Assume that the helical conductors are 5 μm to 20 μm in thickness and substrate 1 has dimensions of 7 mm in diameter and 23 mm in length, for instance; helical conductors 7, 8 and 9 need electrode lengths of 15 mm to 20 mm, 20 mm to 30 mm and 50 mm to 60 mm around substrate 1, respectively. The minimum spacing required between helical conductors 7 and 8 and another minimum spacing between helical conductors 8 and 9 are 0.1 mm to 0.2 mm and 0.1 mm to 0.2 mm, respectively. However, the electrode lengths vary depending upon values of coupled capacitances C1 and C2, and they need adjustment to obtain the optimum characteristics.

Figure 22:
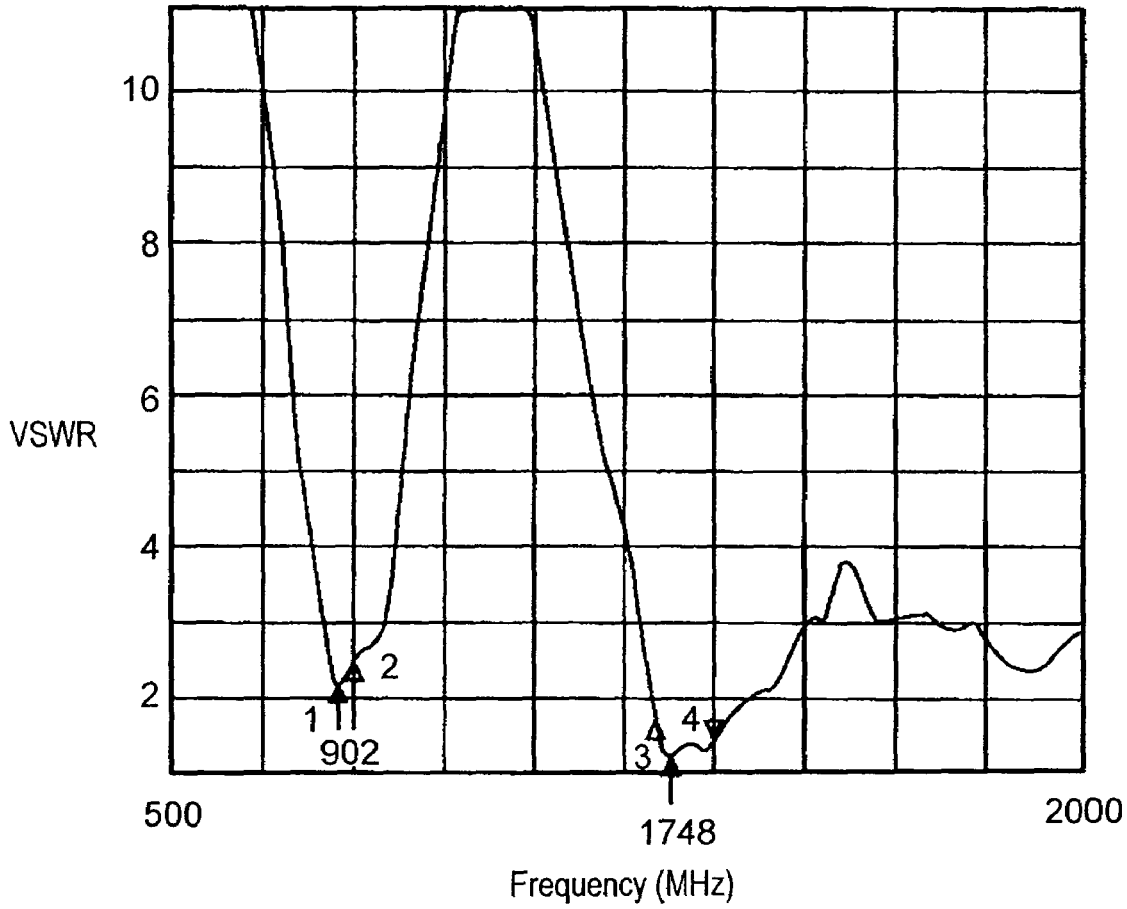
FIG. 22 is a graphic chart showing VSWR of the chip antenna according to the first exemplary embodiment of this invention.
Figure 23:
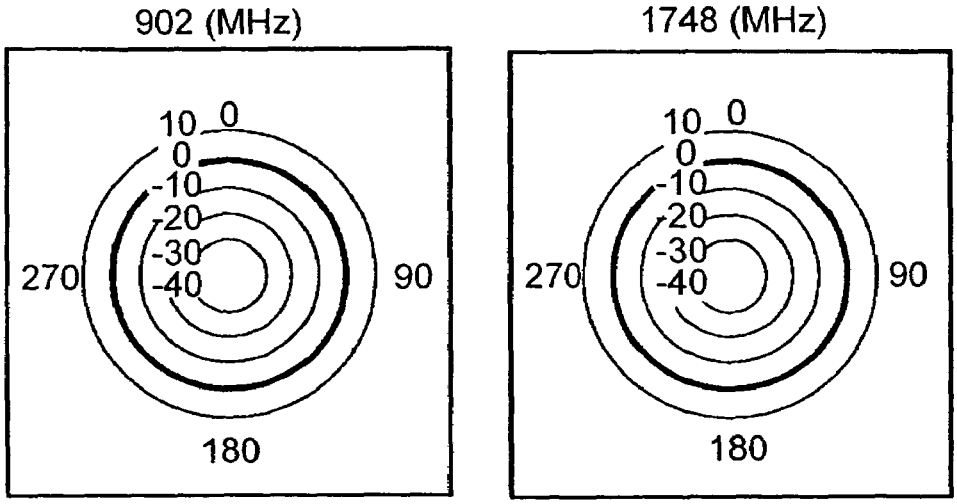
FIG. 23 is a pair of figures showing directivities of the chip antenna according to the first exemplary embodiment of this invention.

Using FIG. 22 and FIG. 23, description is now provided of results of experiments performed on a chip antennas constructed as discussed above.

FIG. 22 is a graphic chart showing VSWR (i.e., voltage standing wave) of the chip antenna according to the first exemplary embodiment, and FIG. 23 is a pair of figures showing directivities of the chip antenna according to the first exemplary embodiment. All of these results were obtained from the course of the experiments.

These experimental results were taken on a chip antenna having two helical conductors on substrate 1, and adjusted to 900 MHz and 1,800 MHz bands. Voltage standing-wave ratio, or VSWR, and directivities were measured on the bands using a network analyzer.

As is obvious from FIG. 22, impedance matching is attained nearly properly, as it shows the voltage standing-wave ratio (VSWR) of less than 3 in the frequency bands for both the GSM cellular phones (880 MHz to 960 MHz) and the DCS cellular phones (1,710 MHz to 1,880 MHz). In other words, this result shows that the chip antenna is capable of performing the transmission and reception, as it yields sufficient gain in the transmission and reception in these frequency bands. It is also clear that the chip antenna performs double resonance at the frequency bands of 900 MHz and 1,800 MHz, so that a single piece of this chip antenna can transmit and receive electromagnetic waves of two different frequencies.

FIG. 23 shows directivities of the chip antenna in the Y- and Z-directions. As is obvious from FIG. 23, the antenna has omni-directional directivity in the frequency bands of both 900 MHz and 1,800 MHz.

As is obvious from the foregoing, this invention realizes the chip antenna of very small single element, yet capable of transmitting and receiving a plurality of communication frequencies. In addition, because of the structure in which the substrate is provided with a plurality of helical conductors with spiral slits, the chip antenna can be made very small as compared to conventional rod antennas, patch antennas, and the like. The chip antenna can be thus built easily into any electronic device that is required to be made small, thin and high integration, such as a portable terminal, notebook type personal computer, and the like.

This invention also realizes the chip antenna be made to a very small element when a $\lambda/4$-type antenna design is employed, thereby providing the very small antenna, a single piece of which can transmit and receive a plurality of frequencies.

The chip antenna in this exemplary embodiment is adaptable for any high frequency band with a practical frequency range of 0.7 to 6.0 GHz, and the desirable dimensions in length L, height H and width W are:

L=4.0 to 40.0 mm;

H=0.5 to 10.0 mm; and

W=0.5 to 10.0 mm.

Any antenna 4.0 mm or smaller in length L cannot establish the required value of inductance. An antenna exceeding 40.0 mm in length L is considered too large in that it makes prohibitive a reduction in size of a circuit board and the like bearing electronic components (hereinafter referred to as a circuit board, etc.), thereby limiting room for downsizing an electronic device in which the circuit board is built in. If both of height H and width W are 0.5 mm or smaller, the antenna element becomes too weak in physical strength in that it can be broken when it is mounted to a circuit board, etc., with a mounting apparatus. Furthermore, if any of height H and width W is 10.0 mm or larger, the antenna element is too large in that it prevents a circuit board and electronic device from being reduced in size.

Second Exemplary Embodiment

FIG. 24, FIG. 25, FIG. 26A and FIG. 26B are perspective views of various chip antennas according to the second exemplary embodiment.

In this exemplary embodiment, description is provided of chip antennas having crown conductors mounted to their open ends for the purpose of widening the frequency band for transmission and reception.

Helical conductors provided in the chip antennas here can be of the type having no electrical continuity as discussed with FIG. 1, or the type having electrical continuity as discussed with FIG. 8.

Figure 24:
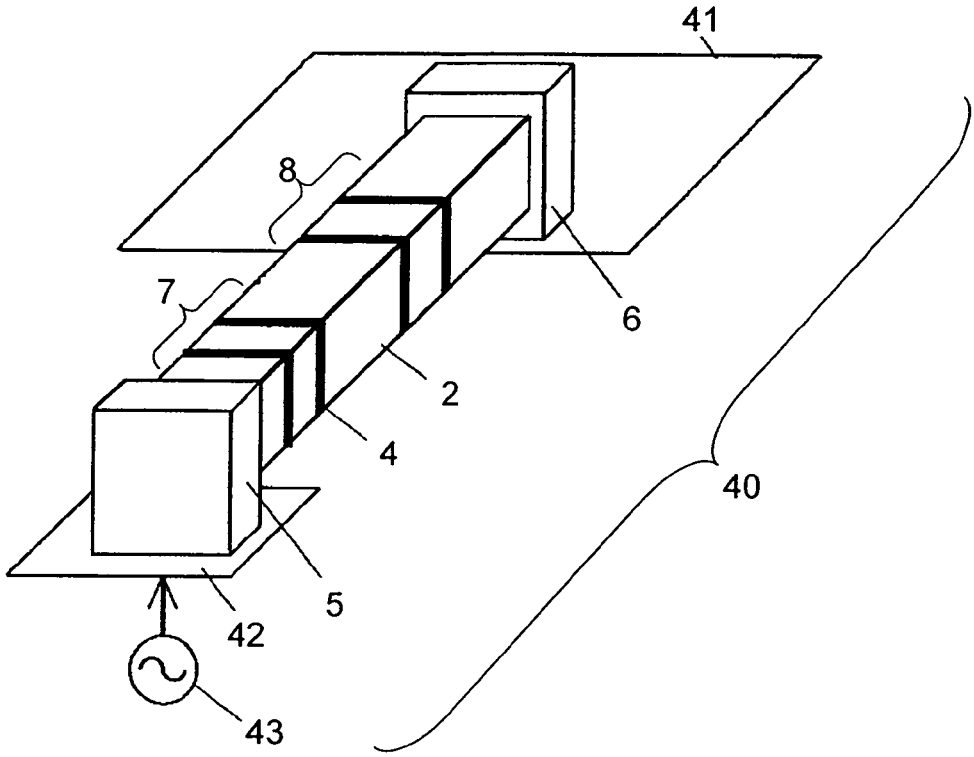
FIG. 24 is a perspective view of a chip antenna according to a second exemplary embodiment of this invention.

Chip antenna 40 comprises crown conductor 41, power feeding point 42, and power feeding section 43. Descriptions will be omitted of components having the same reference characters as FIG. 1. FIG. 24 gives an example having two helical conductors. This chip antenna 40 is of a structure in which helical conductors 7 and 8 are conductively connected with each other.

Figure 25:
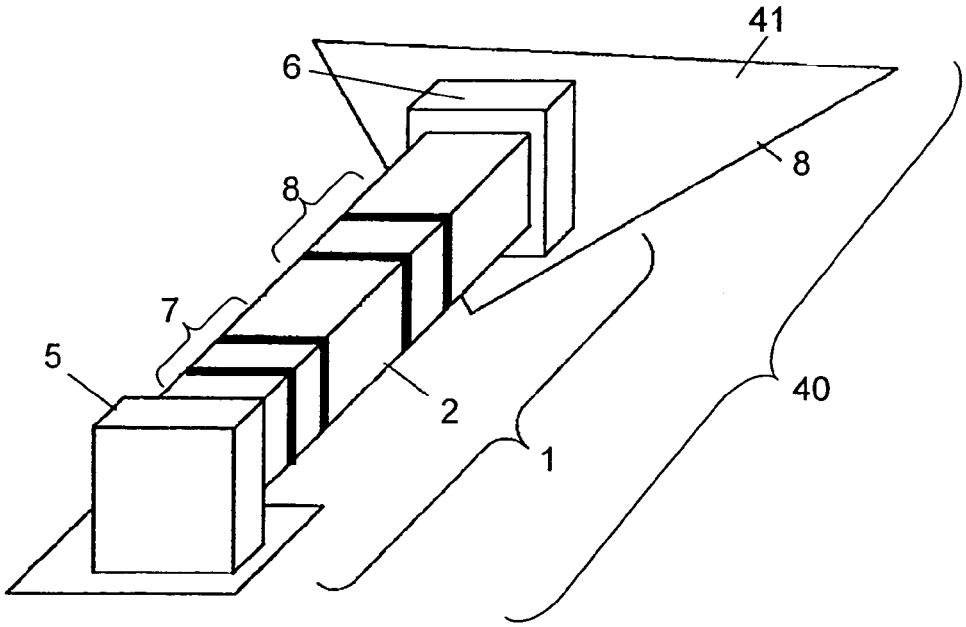
FIG. 25 is a perspective view of another chip antenna according to the second exemplary embodiment of this invention.
Figure 26A:
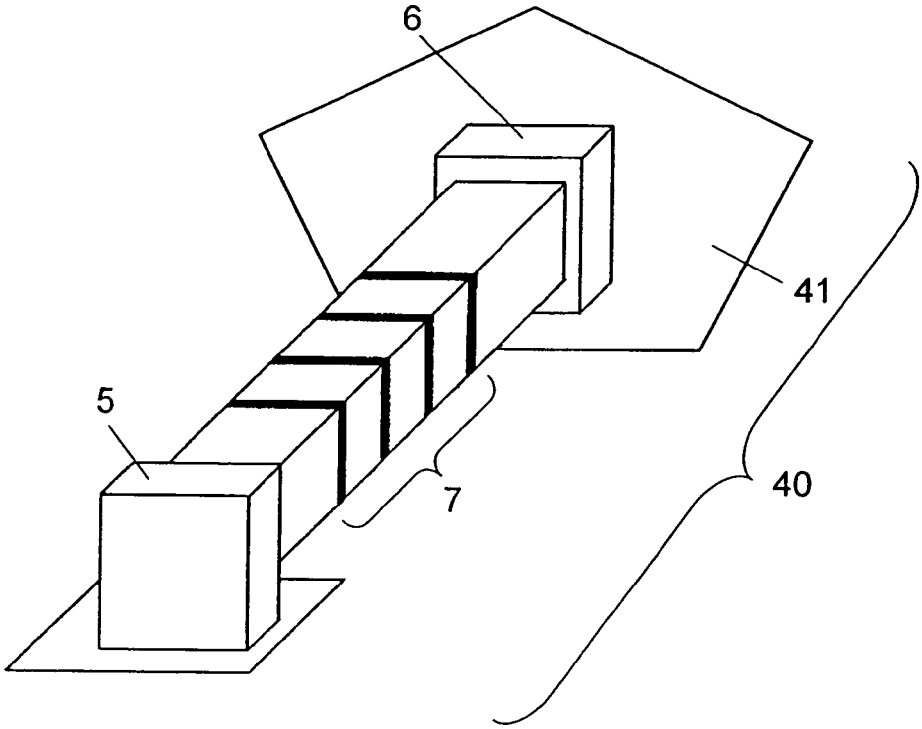
FIG. 26A is a perspective view of still another chip antenna according to the second exemplary embodiment of this invention.

Chip antenna 40 may be of a multi-resonance type having a plurality of helical conductors as shown in FIG. 24 and FIG. 25, or a single-resonance type having only one helical conductor as shown in FIG. 26A.

Power feeding point 42 is formed of a soldering land, a wiring pattern, or the like, and it is connected with terminal 5 by soldering or the like means. Power feeding point 42 receives a signal current supplied from a transmission circuit, and introduces it through terminal 5 to chip antenna 40 which radiates electromagnetic waves. Or, chip antenna 40 delivers a current induced by received electromagnetic waves to a receiving circuit.

Figure 26B:
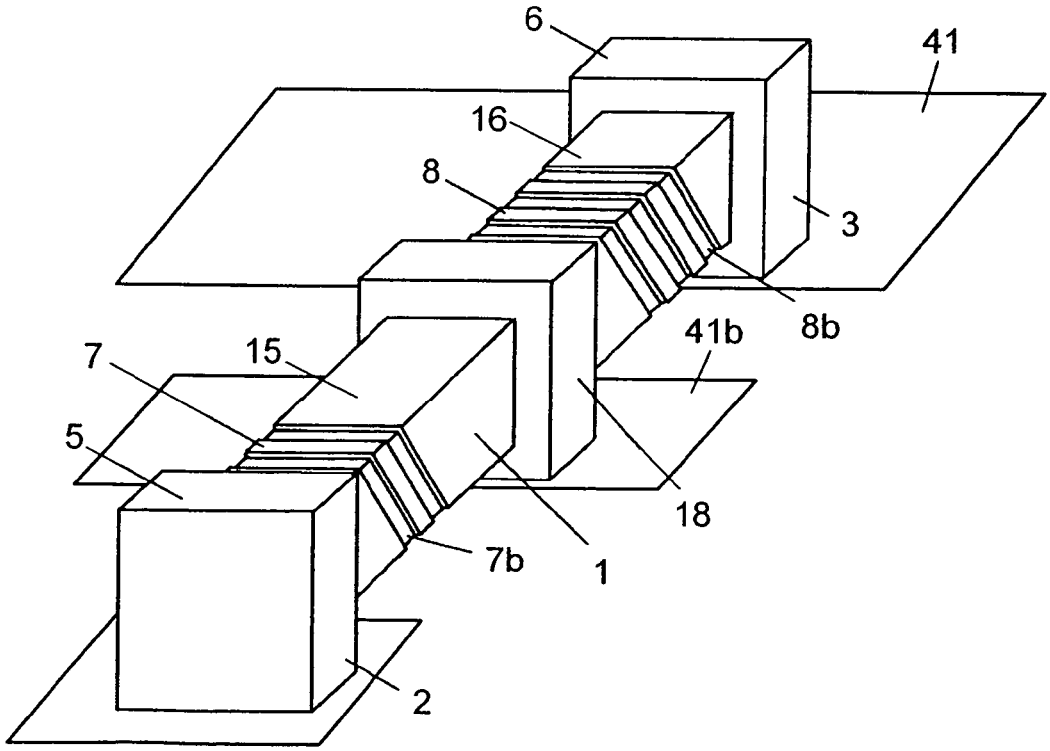
FIG. 26B is a perspective view of yet another chip antenna according to the second exemplary embodiment of this invention.

Crown conductor 41 represents an open end, which is an independent domain not connected with other circuits or an earth ground. Crown conductor 41 is formed of a wiring pattern, a soldering land, or the like, and it is connected with terminal 5 by soldering or the like means. Since crown conductor 41 has a capacitance, it has an equivalent effect for terminal 6 as a connection of a load capacitance. Although FIG. 24 shows crown conductor 41 of quadrangle shape, it can be of any other polygonal shape, such as a triangle and a pentagon. FIG. 25 shows an example of triangular crown conductor 41, and FIG. 26A shows another example of pentagonal crown conductor 41. Furthermore, FIG. 26B shows an example of another antenna provided with crown conductor 41*b* on a mounting surface of protruded portion 18 formed around a non-helical portion. In this structure, crown conductor 41*b* is used as a load capacitance for broadening a bandwidth for resonance frequency associated with helical conductor 7, and crown conductor 41 is used as another load capacitance for resonance frequency associated with helical conductors 7 and 8, thereby realizing wideband operation in each of the multi resonance frequencies.

Crown conductor 41 may be of any other shape, such as an oval and round. Crown conductor 41 expands the frequency bandwidth because the capacitive element it carries is loaded to the open-ended terminal 6. Since a value of the capacitive element is an important factor in this structure, it is desirable to flexibly form the optimum shape of crown conductor 41 in relation to other mounted components to secure the capacitive element. The shape, such as triangle, quadrangle and polygon, and the size may be determined accordingly as appropriate. In the cases where other mounted components are located close to chip antenna 40, crown conductor 41 may be formed into an oblong shape or a flat shape, so as to make it mountable in a proper position with respect to the other components, to achieve as much reduction in the overall mounting area as feasible.

In this structure, an operating frequency band for transmission and reception depends on a value of load capacitance. Crown conductor 41 has a capacitive element, which functions as a load capacitance attached to a tip end of the antenna with reference to power feeding point 42. Therefore, crown conductor 41 represents a load impedance as viewed from power feeding point 42. Here, a rising delay time and a falling delay time of a gain curve in the resonance frequency are proportional to the load impedance. In other words, the rising delay time and the falling delay time of the gain curve in the resonance frequency can change according to a value of the load impedance, or the load capacitance of crown conductor 41. If the load capacitance is small, for instance, a frequency response characteristic representing the gain curve has a sharp peak because the rising delay time and the falling delay time are short in the resonance frequency. If the load capacitance is large, on the other hand, the frequency response characteristic representing the gain curve shows a gently sloped peak because the rising delay time and the falling delay time become long in the resonance frequency. There is a possibility, however, that the gain decreases when the bandwidth is broadened. It is, therefore, essential to find a balance between the optimum gain and the desired bandwidth by adjusting the capacitive element of the load capacitance by choosing a proper size and dielectric constant of crown conductor 41 representing the load capacitance.

FIG. 27 is a graphical representation showing frequency response curves according to the second exemplary embodiment. There are two frequency response curves, one representing the case of a small load capacitance, and the other representing the case of a large load capacitance. The curve for the small load capacitance indicates a sharp peak with an increase of the gain at the resonance frequency, whereas the curve for the large load capacitance indicates a gentle peak with an increase of the gain. The gentler the slope of the peak, the wider the operating frequency band in the transmitting and receiving frequency, so that the frequency band can be widened by increasing the capacitance value provided by crown conductor 41.

It is important to broaden the bandwidth by increasing the load capacitance by using crown conductor 41 because of the need of a sufficiently wide operating frequency band due to the recent trend of expansion in the amount of data transmission in wireless communications. The above techniques are suitable especially for the multi-career transmissions such as OFDM (i.e., orthogonal frequency division multiplexing) in the recent years which requires a wide band.

Description is provided next of a result of experiments exhibiting the fact that crown conductor 41 widens the frequency band. FIG. 28 is a graphical representation showing the result of experiments performed in the second exemplary embodiment. Graph 1-1 shows a relation between a provided longitudinal dimension of crown conductor 41 and bandwidth in which VSWR is equal to or smaller than a predetermined value representing the proper resonance condition. The curve indicates changes in the bandwidth when a surface area of crown conductor 41 is increased by increasing a longitudinal dimension of the quadrangular crown conductor 41 while a widthwise dimension is unchanged. The predetermined value of VSWR used here is "3".

In this graph 1-1, the axis of abscissas shows longitudinal dimension and the axis of ordinates shows bandwidth. The area of crown conductor 41 increases as the longitudinal dimension increases. The increase in the area means an increase in value of capacitive element C1. As is apparent from graph 1-1, the bandwidth expands as the longitudinal dimension increases. It was confirmed that the bandwidth expands 40% when the longitudinal dimension is increased to 10 mm as oppose to 4 mm. This makes possible an increase in data transmission rate by 40% when a modulation method, error correction rate and data speed are kept the same.

Graph 1-2 shows a relation between longitudinal dimension of crown conductor 41 representing the area of crown conductor 41 and gain in the transmission and reception. As is clear from graph 1-2, it is possible to expand the frequency band by adjusting the area of crown conductor 41 without causing any problems, such as decrease in the gain, and an adverse effect on the performance, even when the expansion is made in the frequency band by way of increasing the longitudinal dimension of crown conductor 41.

The increase in longitudinal dimension and the increase in bandwidth are generally in direct proportion to each other. It is known in the calculation formula of Q value that the bandwidth is proportional to the square root of capacitance "$\sqrt{C}$", the capacitance "C" is proportional to the area of crown conductor 41, and the area of crown conductor 41 is proportional to the second power of a side length of crown conductor 41, if it has a square shape. Accordingly, a conclusion of the above is that the bandwidth is proportional to the longitudinal dimension, or the side length of crown conductor 41. It is also apparent that this theory is proven by the result obtained from graph 1-1.

In this connection, the load capacitance can be formed by using a capacitance in possession of terminal 6 connected to the open end and another capacitance provided by a portion of the circuit board to which terminal 6 is connected. However, this requires some additional measures, such as extending a length of substrate 1 and increasing a width of terminal 6, to ensure a sufficient amount of capacitance. These measures present disadvantages, such as an increase in size of the chip antenna and additional manufacturing processes. To the contrary, this invention makes sufficient load capacitance easily obtainable by connecting terminal 6 to a soldering land, and forming crown conductor 41 at the tip end thereof. In addition, the invention also provides for advantages that crown conductor 41 can be formed easily to increase the load capacitance, and into any shape with flexibility, while taking into account a positional relation to the other mounted components, even after completion of manufacturing the chip antenna.

Figure 29:
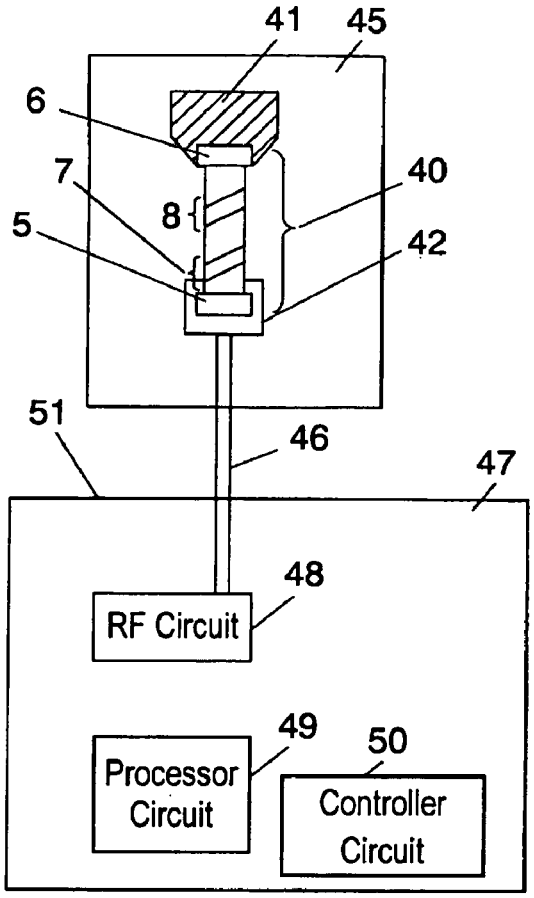
FIG. 29 is a schematic illustration showing a structure of an antenna device according to the second exemplary embodiment of this invention.

FIG. 29 is a diagram showing a structure of an antenna device according to the second exemplary embodiment. The chip antenna is mounted to a circuit board, and provided with a crown conductor in connection to an open end of the chip antenna.

Figure 30:
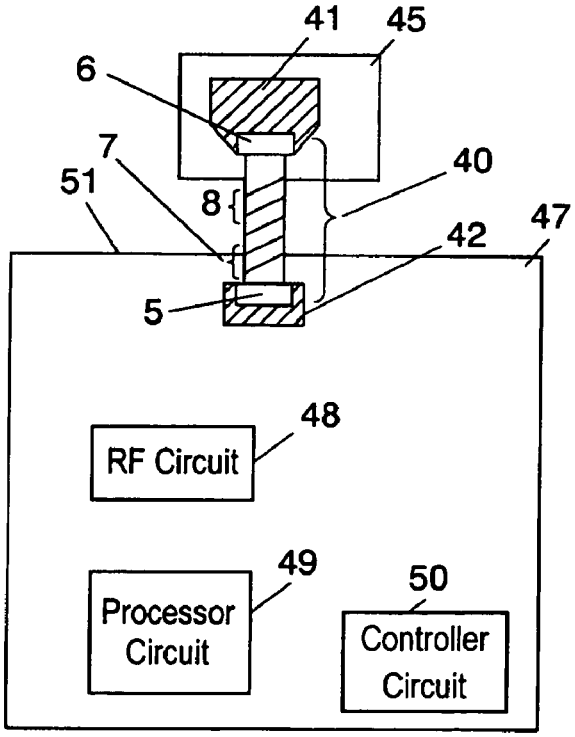
FIG. 30 is a schematic illustration showing a structure of another antenna device according to the second exemplary embodiment of this invention.

The chip antenna comprises main circuit board 47, supplementary board 45, power feeder line 46, RF circuit 48, processor circuit 49, control circuit 50 and side edge 51 of main circuit board 47. Main circuit board 47 and supplementary board 45 are placed on a level with respect to each other, and they are connected electrically through power feeder line 46. An area other than that occupied by RF circuit 48, processor circuit 49 and control circuit 50 on main circuit board 47 is covered with a grounding plate. Control circuit 50 is for controlling processor circuit 49 and the like, and it uses a CPU, a custom-made IC, etc. Processor circuit 49 performs such functions as modulation and addition of an error code during transmission of signals, and demodulation and error correction during reception of signals. Signals modulated in processor circuit 49 are converted by RF circuit 48 into signals of the transmission frequency, and output to chip antenna 40 through power feeder line 46. On the other hand, signals received in chip antenna 40 are output to RF circuit 48 through power feeder line 46, frequency-converted in RF circuit 48, and demodulated in processor circuit 49. Chip antenna 40, shown in FIGS. 29 and 30, is of the double-resonance type having two helical conductors connected electrically. However, it can be a chip antenna of another type, including un-connected helical conductors, and the one adaptable for triple resonance and more.

When an antenna device is built into a cellular phone or a notebook type computer, there are often cases where it is more appropriate to mount the antenna device to separate supplementary board 45 than mounting it to main circuit board 47, which bears a variety of processing circuits, in view of a limitation of available mounting area and ease of the mounting process. That is, the mounting process can be simplified by mounting chip antenna 40 on supplementary board 45 in advance, and connecting it to main circuit board 47 with power feeder line 46. If chip antenna 40 is mounted to main circuit board 47, on the contrary, there is a risk of degradation in the performance due to mutual interference by noises and the like, since main circuit board 47 carries RF circuit 48 in addition to processor circuit 49. It is for this reason that mounting chip antenna 40 on the separate supplementary board 45 provides an advantage. It also provides another advantage in that supplementary board 45 can provide chip antenna 40 with greater flexibility in ensuring a space for crown conductor 41 of a shape and surface area necessary to expand the frequency band.

When the chip antenna 40 is of the λ/4 type, it generates an image current in a surface of the grounding plate on main circuit board 47. When chip antenna 40 is mounted in an orientation generally orthogonal to side edge 51 of main circuit board 47 in this example, the image current generated in the grounding plate of main circuit board 47 has generally the same vector as a current flowing in chip antenna 40, so as to improve the transmission and reception gain of chip antenna 40. It is, thus, preferable to mount chip antenna 40 in the orientation generally orthogonal to main circuit board 47. Especially when chip antenna 40 is of the λ/4 type antenna, it generates an induced current of λ/2 equivalence, including the image current; and it is, therefore, important that chip antenna 40 generates the image current efficiently. It is, thus, inevitable that main circuit board 47 having the grounding plate for allowing the generated image current to flow, and supplementary board 45 bearing chip antenna 40 are placed on generally the same plane.

Existence of crown conductor 41 increases the load capacitance and, therefore, broadens the frequency band, as a matter of course, and optimizes chip antenna 40 for wireless communications of high transmission rate.

As described, the invention can ensure a sufficient level of the transmission and reception gain and improve performance of chip antenna 40, while suppressing noises and maintaining design flexibility of crown conductor 41 by way of mounting chip antenna 40 on the supplementary board separate from the main circuit board, and setting the two circuit boards on generally the same plane. In addition, this structure can reduce a space for mounting main circuit board 47 bearing processor circuit 49 and the like and supplementary board 45 bearing chip antenna 40 when they are built into a cellular phone or a notebook type computer, since they are placed on generally the same plane. The performance of the antenna device, such as a level of transmission and reception gain, can be kept sufficiently high even in the above case.

FIG. 30 is a diagram showing a structure of another antenna device according to the second exemplary embodiment. FIG. 30 shows an example in which chip antenna 40 is mounted across main circuit board 47 and supplementary board 45, which is placed on generally the same plane with main circuit board 47.

Power feeding point 42 is provided on main circuit board 47, and terminal 5 of chip antenna 40 is connected to power feeding point 42. On the other hand, crown conductor 41 is provided on supplementary board 45, and terminal 6 of chip antenna 40 is connected to crown conductor 41. That is, main circuit board 47 and supplementary board 45 are connected to each other via chip antenna 40. The invention, even with this structure, has an advantage of increasing flexibility of designing shape and surface area of crown conductor 41, and reducing a space for mounting main circuit board 47 and supplementary board 45 to thereby realize downsizing and low-profiling of electronic devices, since both main circuit board 47 and supplementary board 45 are placed on the same plane. It is desirable to form supplementary board 45 into such a shape and size that match with a shape and size of crown conductor 41. Or, supplementary board 45 may be made into generally the same shape and size as that of crown conductor 41 to minimize the dimensions of supplementary board 45.

Since chip antenna 40 is in an orientation generally orthogonal to side edge 51 of main circuit board 47, an image current generated by chip antenna 40 in the grounding plate of main circuit board 47 has generally the same vector as a current flowing in chip antenna 40, so as to have an advantage of improving the transmission and reception gain. It is especially important, when chip antenna 40 is of the λ/4 type antenna, that it generates the image current of the same vector as that of chip antenna 40, since it needs to improve the transmission and reception gain by generating the image current (the image current then produces an induced current equivalent to that of a λ/2 type antenna). It is for this reason that chip antenna 40 needs to be mounted in the orientation generally orthogonal to side edge 51 of main circuit board 47. In a circumstance where orthogonal mounting is not feasible, chip antenna 40 may be mounted with an angle from the orthogonal orientation according to mounting conditions and other situations of the electronic device, taking into consideration a balance with the drawback in the performance. The grounding plate of main circuit board 47 can be used as a grounding plate for generating the image current, even in the above case, to take advantage of improving the transmission and reception gain, and this is important, especially for chip antenna 40 of the λ/4 type.

The above structure makes possible the use of the grounding plate of main circuit board 47, on which processor circuit 49 and the like are mounted, as a grounding plate for chip antenna 40, and chip antenna 40 can be utilized as a λ/4 type antenna. This can, thus, miniaturize chip antenna 40 and therefore, the antenna device. The above structure reduces a space for mounting the antenna device when built into an electronic device, thereby realizing low-profiling and downsizing of the electronic device. It can, thus, improve transmission and reception gain by the image current and performance of expanding the frequency band by the function of crown conductor 41, while still maintaining the downsizing as described. This expansion of the frequency band achieves wireless communications of high transmission rate.

It is also suitable for the electronic device to employ two or more units of chip antenna 40 for multi-channel capability with additional transmission and reception frequencies.

If an edge of the grounding plate formed on main circuit board 47 is not in parallel with side edge 51 of main circuit board 47, chip antenna 40 needs to be mounted generally in the orthogonal orientation to the edge of the grounding plate, rather than side edge 51. In this way, chip antenna 40 can make good use of the generated image current.

The invention is also useful for improvement of receiving performance of the electronic device when adapted for diversity by using a plurality of chip antennas. When mounting two antenna devices, for instance, it is suitable to perform selective diversity for improvement of the receiving performance by selectively demodulating signals of high power received in the antenna devices, and the combining diversity for making a maximum ratio combined based on the received power.

As discussed above, the antenna device can achieve the wideband operation by providing the crown conductor, improve high gain by mounting the crown conductor on the supplementary board placed generally on the same plane as the main board and using the grounding plate provided on the main board, and ensure design flexibility in shape and area size of the crown conductor by mounting the crown conductor on the supplementary board.

Third Exemplary Embodiment

In this third exemplary embodiment, description is provided of a method of reducing a mounting space while maintaining performance of a chip antenna when the chip antenna is mounted on a portable terminal and the like.

It is often a common practice to mount a chip antenna to a top portion of a circuit board when mounting it into a portable terminal and the like. This requires a large area on the circuit board. Consequently, this makes a large length of the circuit board inevitable, and so makes the portable terminal to accommodate the circuit board, thereby making it difficult to accomplish downsizing.

In the case of using a chip antenna of the $\lambda/4$ type for the reason of downsizing, in particular, a grounding plate of sufficient size is necessary for ensuring the required gain. This necessitates a space of large length for mounting the antenna because it is also dependent upon the grounding plate. Corresponding to the above, there gives rise to a problem that a further increase in length of both the circuit board and the electronic device is unavoidable.

To the contrary, use of a chip antenna in this exemplary embodiment can realize the optimum mounting structure inside the portable terminal and the like for which downsizing is desired, since the chip antenna utilizes an available space three dimensionally and effectively to reduce the mounting length.

FIG. 31, FIG. 32, FIG. 33 and FIG. 34 are schematic views showing structures of antenna devices according to the third exemplary embodiment.

The antenna device comprises chip antenna 55, circuit board 56, circuit mounting area 57, antenna mounting board 58, grounding plate 59, angled portion 60 and reduced length 61.

Figure 31:
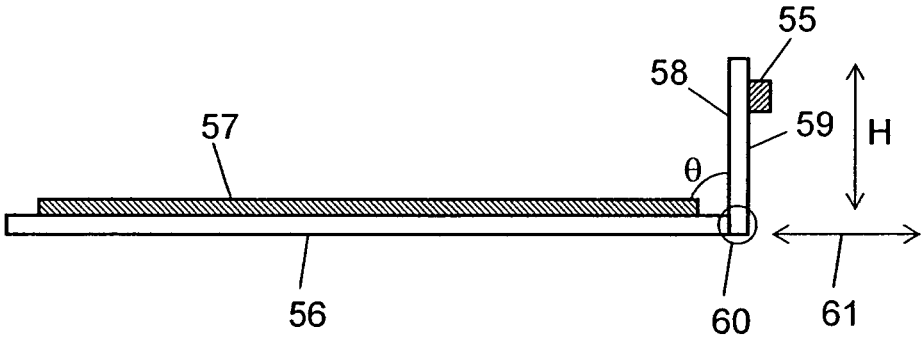
FIG. 31 is a schematic view showing a structure of an antenna device according to a third exemplary embodiment of this invention.

As is clear in FIG. 31, a main surface of antenna mounting board 58 is tilted with respect to a main surface of circuit board 56 (i.e., a surface where circuit mounting area 57 is allocated). Circuit board 56 and antenna mounting board 58 are connected electrically. Chip antenna 55 receives signals and transfers them to circuit elements mounted on circuit board 56. On the other hand, the circuit elements supply signals to chip antenna 55. All that is required for circuit board 56 and antenna mounting board 58 is that they are connected electricity with a tilting angle, and that they may be constructed of a solid piece of epoxy board bent into the angle, or separately prepared circuit board 56 and antenna mounting board 58 arranged together with the angle. To arrange circuit board 56 and antenna mounting board 58 with the tilt angle in this manner, they can be put together with adhesive bonding, welding, mechanical fitting, screw mounting and the like, with or without a physical gap between them.

Chip antenna 55 may be of any kind, having a plurality of helical conductors, or a single-resonance type having only one helical conductor.

Alternatively, circuit board 56 and antenna mounting board 58 may be made separately and mechanically crimped thereafter.

It is also desirable to place a shield plate on circuit board 56 between antenna mounting board 58 and the circuit elements, although not illustrated in FIG. 31. The shield plate can positively alleviate mutual interference between them.

Though the angle of tilted portion 60 between circuit board 56 and antenna mounting board 58 can be determined arbitrarily according to a shape, etc. of an enclosure, it is desirable that this angle $\theta$ formed by circuit board 56 and its confronting surface of antenna mounting board 58 is 90 degrees or less in order to maximize reduced length 60. It is also possible to reduce height H of the antenna mounting board by further reducing the angle $\theta$ smaller than 90 degrees. However, it gives rise to a problem such as mutual interference if the angle $\theta$ is made excessively small because the chip antenna gets too close to the circuit elements in circuit mounting area 57. It is, therefore, desirable to set the angle between 70 and 100 degrees, and it is even preferable to keep a generally perpendicular angle in view of the strength and workability.

In the conventional devices, circuit board 56 and antenna mounting board 58 are not separated, but assembled into a single board placed on one and the same plane. To the contrary, the structure in FIG. 31 is such that antenna mounting board 58 is bent about angled portion 60, and chip antenna 55 and grounding plate 59 are mounted to this antenna mounting board 58.

This structure effectively uses space three-dimensionally by tilting antenna mounting board 58 against circuit board 56 where LSI and discrete elements in the processing circuit are mounted, so as to save a space designated as reduced length 61. This reduces the overall length of the circuit board by an extent of reduced length 61, to realize downsizing of the enclosure for accommodating these boards, or the electronic device. Especially, since those devices, such as portable terminals, have the sizes and shapes of their enclosures depend greatly upon the circuit boards, the space saved by reduced length 61 can shorten the length of the portable terminals in meeting the demands of downsizing. In the structure of the conventional devices, in which various processing circuits and an antenna element are mounted on a circuit board of a flat plane, the antenna element requires a wide buffer zone from circuit mounting area 57 to prevent it from receiving interferences from the circuit elements. The embodied structure having the tilted antenna mounting board 58 can reduce the buffer zone, since it alleviates the mutual interferences with these circuit elements. Because of this reason, the height H of the bent-up antenna mounting board 58 does not need to be equally as large as the reduced length 61. Although the height H of antenna mounting board 58 dominates a thickness of the enclosure in which these boards are housed, there is hardly any disadvantage in requiring an added thickness to the enclosure, since a part of reduced length 61 is contributed by the reduction of the buffer zone and that not every inch is turned to the height H. Accordingly, this embodiment can reduce an overall volume of devices such as the portable terminal by realizing a reduction in length without increasing the thickness.

As stated, the embodiment utilizes space three-dimensionally to improve the mounting efficiency as a whole while maintaining the performance, such as the gain. Though this embodiment is used very suitably for portable terminals such as cellular phones, it can also be used suitably for other electronic devices with the capability of wireless communications, such as notebook computers equipped with wireless LAN, for instance.

Figure 32:
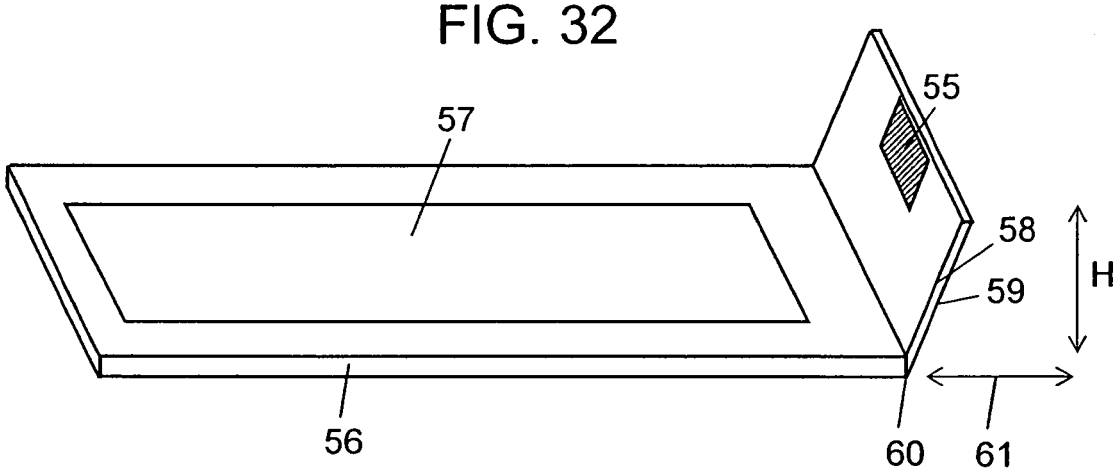
FIG. 32 is a schematic view showing a structure of another antenna device according to the third exemplary embodiment of this invention.

In FIG. 32, chip antenna 55 is mounted in a position generally in parallel with a line of bonding between antenna mounting board 58 and circuit board 56. When chip antenna 55 is mounted generally in parallel, it does not receive a good contribution of an image current generated in grounding plate 59 toward increasing density of a current generated within chip antenna 55, and thereby, it retards the improvement of transmission and reception gain. However, it still has the advantage of reducing the overall volume of mounting, since it naturally reduces the height H of antenna mounting board 58.

Figure 33:
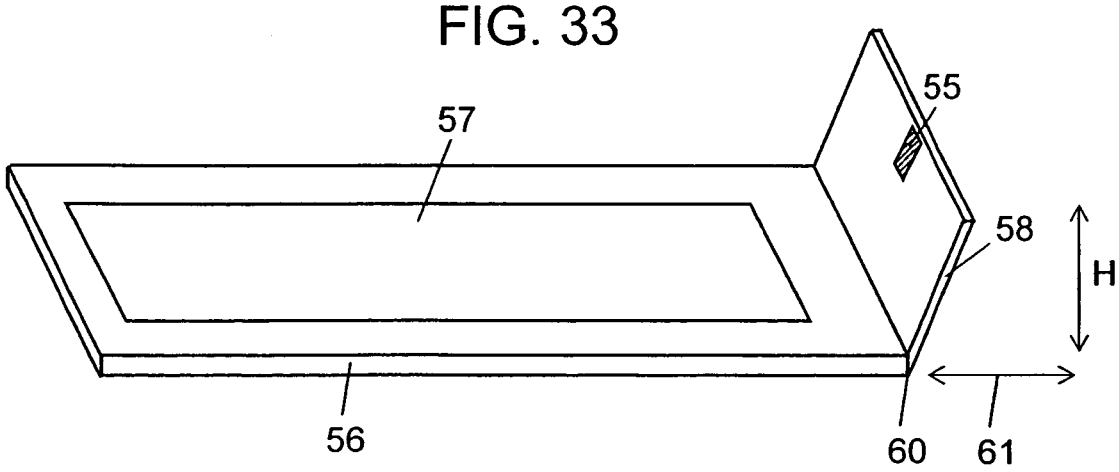
FIG. 33 is a schematic view showing a structure of another antenna device according to the third exemplary embodiment of this invention.

In FIG. 33, chip antenna 55 is mounted in a position generally orthogonal to a line of bonding between circuit board 56 and antenna mounting board 58. In this case, contribution of the image current toward improvement of the transmission and reception gain of chip antenna 55 becomes nearly the maximum, since the image current generated in grounding plate 59 has the same vector as to increase density of the current generated in chip antenna 55. This arrangement of mounting chip antenna 55 being generally orthogonal can, thus, provide an advantage of maximizing the transmission and reception gain although the height H of antenna mounting board 58 also becomes the maximum dimension.

Figure 34:
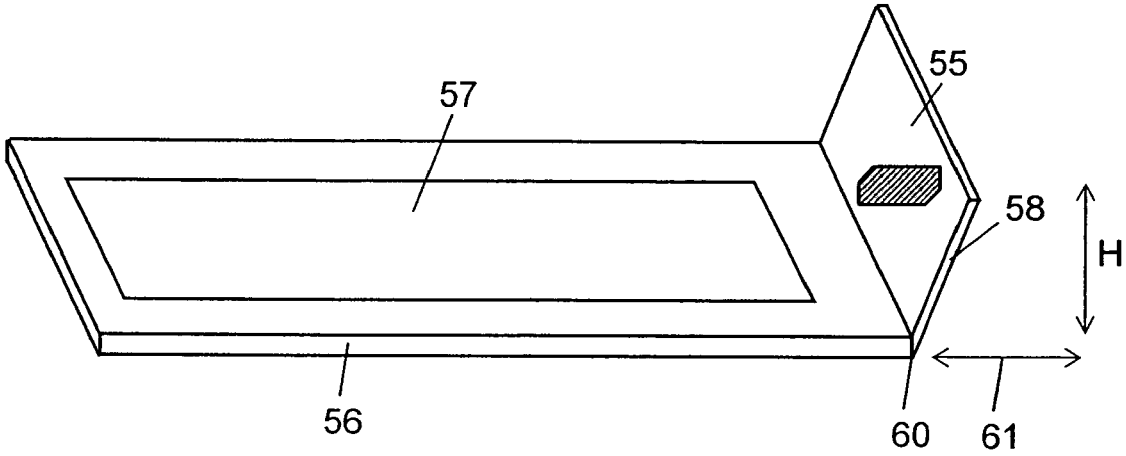
FIG. 34 is a schematic view showing a structure of still another antenna device according to the third exemplary embodiment of this invention.

In FIG. 34, on the other hand, chip antenna 55 is mounted diagonally. In this example, contribution of the image current generated in grounding plate 59 toward improvement of the transmission and reception gain is of a medium level, and height H required for the mounting also becomes medium in dimension. This mounting orientation is, therefore, suitable for adjusting a balance between transmission and reception gain and height H of antenna mounting board 58. When mounting chip antenna 55 is diagonal, it is preferable that chip antenna 55 is arranged to form a tilting angle between 30 degrees and 60 degrees with respect to the line of bonding to achieve the balance most appropriately. However, this does not necessarily mean to exclude other mounting angles.

It is desirable that chip antenna 55 is mounted on a surface of antenna mounting board 58 behind the other surface confronting circuit board 56. This mounting position alleviates mutual interference between chip antenna 55 and a variety of circuit elements mounted on circuit mounting area 57, and improves performance of the antenna. In addition, this can further reduce the buffer zone discussed above. In the case of cellular phones, it is a common practice that antenna mounting board 58 is located inside an upper space thereof because of the demand of users. Chip antenna 55, if mounted on the back surface of antenna mounting board 58, can get a wider angle of unobstructed outer space from the upper portion of the cellular phone, which provides for an advantage of improving the transmitting and receiving performance. Chip antenna 55 may, of course, be mounted to the surface of antenna mounting board 58 that confronts circuit board 56 when necessary, taking into account a performance level of the antenna. It is also desirable to increase a load capacitance and establish a wide frequency band by providing a crown conductor on the open end of chip antenna 55, as discussed in the second exemplary embodiment. The crown conductor can be formed into any variation in shape using a circuit pattern, solder land, and the like.

Figure 35:
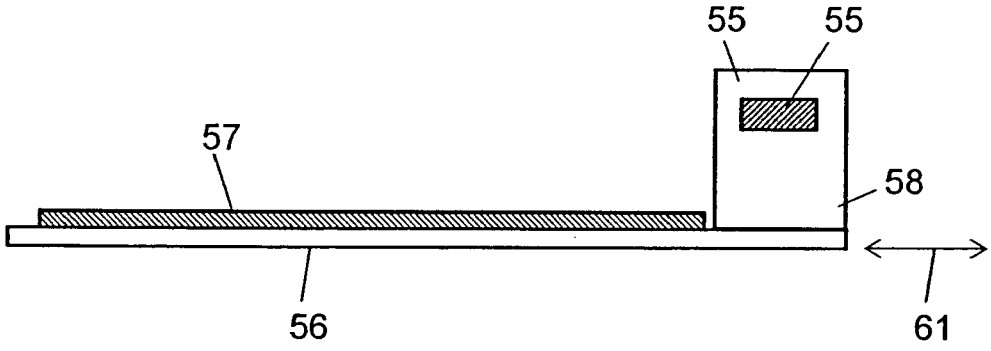
FIG. 35 is a schematic view showing a structure of yet another antenna device according to the third exemplary embodiment of this invention.

Moreover, antenna mounting board 58 may be mounted in a longitudinal direction of circuit board 56, as shown in FIG. 35. By mounting antenna mounting board 58 in parallel with the longitudinal direction of circuit board 56, chip antenna 55 is also arranged in the parallel orientation with the longitudinal direction which keeps the axis of directivity in line with the longitudinal direction. This can, thus, yield an effective directivity in cellular phones and the like. Antenna mounting board 58 can be positioned not only in the parallel orientation with the longitudinal direction of circuit board 56, but also with a certain angle in order to adjust the directivity.

Next, a sample of this antenna device was actually produced, and a volume was measured for the device, in which chip antenna 55 is mounted to antenna mounting board 58 bonded to circuit board 56 with the tilt angle according to this invention, as opposed to another sample of the prior art in which chip antenna 55 is mounted to a circuit board of single flat plane.

In each case, circuit board 56 of a size necessary to mount required processing circuits, chip antenna 55, antenna mounting board 58, and a power supply were assembled together, and a volume occupied by them was measured as a necessary storing volume. The necessary storing volumes were 4,720 $mm^2$ for the sample of the prior art technique and 3,135 $mm^2$ for the sample produced according to this invention, which yielded a reduction of nearly 35% in volume. Naturally, an overall length of the circuit board is reduced.

Next, description is given of the fact that the satisfactory antenna performance was obtained even with the chip antenna mounted in the above manner.

FIG. 36A, FIG. 36B and FIG. 36C show results of experiments on the conventional antenna device in which a chip antenna is mounted to a circuit board of a single flat plane. FIG. 36A is a schematic illustration showing a structure of the antenna used for the experiment, FIG. 36B is a graphic chart showing a result of the experiment for VSWR, and FIG. 36C is an illustration showing a result of the experiment for gain characteristic. FIG. 37A, FIG. 37B and FIG. 37C show results of experiments on samples of the third exemplary embodiment. FIG. 37A is a schematic illustration showing a structure of the antenna used for the experiment, FIG. 37B is a graphic chart showing a result of the experiment for VSWR, and FIG. 37C is an illustration showing a result of the experiment for gain characteristic.

As clearly shown in FIG. 36A and FIG. 37A, the device of the prior art technique has the chip antenna mounted to the circuit board of single flat plane, and the device of this invention has the chip antenna mounted to the antenna mounting board. As is obvious from these results of the experiment for VSWR characteristic, the antenna device of this invention compares favorably with the antenna device of the prior art. Furthermore, it is also clear from FIG. 36C and FIG. 37C that antenna device of this invention has an equal or better gain characteristic and the antenna performance is secured sufficiently.

As is now known from the above results, the structure in which chip antenna 55 and grounding plate 59 mounted to antenna mounting board 58 arranged at the tilt angle to circuit board 56 can realize effective use of the three-dimensional space without degrading the antenna performance, such as the transmission and reception gain, and thereby achieving reduction in length and overall size of an electronic apparatus.

Accordingly, when the antenna device is so designed in advance that a length of circuit board 56 is smaller than a length of a housing enclosure, and a height H of antenna mounting board 58 is also smaller than a thickness of the housing enclosure, the antenna device satisfies dimensional specifications required for the electronic apparatus.

Figure 38A:
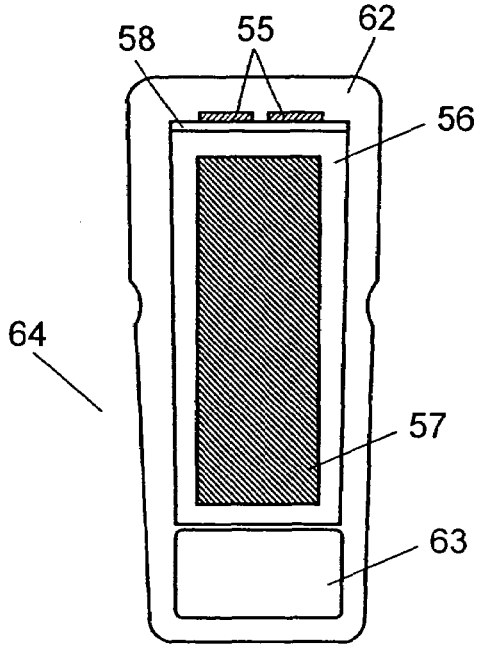
FIG. 38A is a schematic illustration showing a structure of a cellular phone according to the third exemplary embodiment of this invention.
Figure 38B:
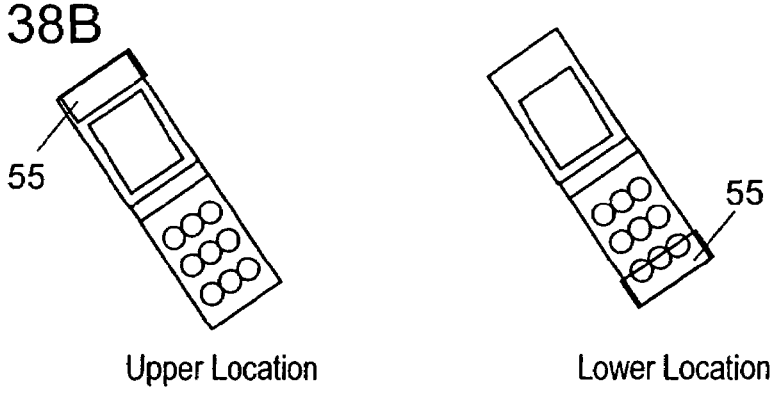
FIG. 38B is an illustration showing verification of SAR data in the third exemplary embodiment of this invention.

FIG. 38A and FIG. 38B are schematic illustrations showing a structure of a cellular phone according to the third exemplary embodiment, wherein chip antenna 55 is mounted on tilted antenna mounting board 58. Although FIG. 38A and FIG. 38B show the cellular phone as an example of the electronic apparatus, this is not restrictive, and the invention includes other electronic apparatuses for wireless communications, such as a variety of portable terminals, PDA's and notebook-type computers.

This cellular phone contains power supply 63 and cellular phone 64 inside enclosure 62, and it shows an example having two chip antennas 55. This is the design intended for diversity and an additional plurality of multi resonances. As is apparent from FIG. 38A and FIG. 38B, antenna mounting board 58 is arranged with a tilt angle to circuit board 56, to use the three dimensional space effectively and reduce the length for mounting. The invention is, thus, very effective for reduction in length and overall size of portable terminals such as cellular phones.

Such a portable terminal operates in a manner which is described hereinafter.

Chip antennas 55 are mounted on antenna mounting board 58 bonded at a certain angle to circuit board 56. Circuit mounting area 57 bears a processing device. During a reception mode, one of chip antennas 55 receives electromagnetic waves delivered from outer space. The received signals undergo down conversion for lowering the frequency when necessary, and original analog data or digital data are recovered after detection and demodulation. Sounds and images are reproduced from the recovered data after error detection and error correction are performed, if necessary. The reproduced sounds and images are turned into a usable form by a speaker, an LCD screen, and the like for a user.

In a transmission mode, the processing device performs a pre-transmission process to perform modulation on necessary data. Chip antenna 55 transmits the data signal subjected to the transmission process to outer space as electromagnetic waves to complete the transmission.

During the transmission and reception, since these chip antennas are adapted to the plurality of frequencies, they can receive any desired frequency band between the 900 MHz band and 1,800 MHz band in the reception mode, and transmit with the desired frequency in the transmission mode.

Because of the above antenna device, in which the antenna mounting board bearing the chip antenna and the necessary grounding plate is arranged at the set angle to the circuit board provided with circuit elements, this structure allows for effective use of the three dimensional space for mounting the chip antenna. In addition, since the length required for mounting the antenna can be excluded from the same single plane, the invention can shorten a length of the circuit board, and as a result, reduce longitudinal dimensions of the housing enclosure, as well as the electronic device. Moreover, because the antenna mounting board is tilted and the chip antenna is mounted on the back side of the antenna mounting board, it does not require a buffer zone to prevent interference and the like, which, thus, requires the antenna mounting board of only a small height. Therefore, the enclosure can be reduced in size without making any adverse influence to a thickness of the enclosure, even though the antenna mounting board is tilted.

In addition, since the chip antenna and the grounding plate corresponding thereto are provided on the antenna mounting board formed at the tilted angle to the circuit board, this invention can ensure sufficient antenna performance, such as the transmission and reception gain.

Description is provided next of an embodiment in which the chip antenna is mounted inside one end of a portable terminal which is positioned at the lower side when the portable terminal is used.

There is a concern for SAR (i.e., Specific Absorption Rate), which is an influence of electromagnetic radiation from the antenna during use of a portable terminal. The chip antenna mounted in the portion of the portable terminal which is positioned at the lower side during use is very effective as a measure to reduce this influence. This structure is achieved by mounting the chip antenna to a portion of the circuit board that goes into the lower side of the portable terminal during use, when the circuit board is built into the enclosure to complete the portable terminal. Alternatively, the same structure can be achieved by mounting the main board attached with the angled antenna mounting board in such a manner that the antenna mounting board is located at the lower side of the portable terminal. Because the chip antenna is produced with the helical conductors formed on the substrate, it is so small that it can be mounted into the lower side space without obstructing downsizing and low-profiling of the portable terminal. Moreover, this arrangement of positioning the antenna mounting board angled to the circuit board in the lower side space of the portable terminal can realize reduction of the adverse influence of SAR, while achieving the reduction in length of the portable terminal at the same time. Furthermore, the SAR can be further reduced and obstacles to the downsizing and low-profiling of the portable terminal lessened substantially, by placing a shield around the chip antenna and taking advantage of the fact that the chip antenna can be constructed very small in size.

Using FIG. 38B, description is provided of a result of an experiment showing the effect of reducing the SAR when the chip antenna is arranged at the lower side of the portable terminal. FIG. 38B is a verification table for the SAR according to the third exemplary embodiment.

In FIG. 38B, the table includes values of SAR in the case where the chip antenna is arranged at the upper side of the portable terminal and another case where the chip antenna is arranged at the lower side of the same. The chip antenna may be mounted on a circuit board as a separate element, or it may be mounted on an antenna mounting board attached to the circuit board at an angle.

As is apparent from the table in FIG. 38B, the values of SAR are very small at all frequency bands of 900 MHz, 1,800 MHz and 1,900 MHz when the chip antenna is arranged at the lower side, as compared to the case the chip antenna is arranged at the upper side. The values are nearly 1/10 in any of the frequency bands, indicating the substantial ratio of reduction. This reduction in the values of SAR can reduce the adverse effect of the electromagnetic radiation to the user. In other words, it is apparent that the chip antenna operable in multi resonance of this invention can reduce the SAR value at any of the resonance frequencies, and further improve characteristics of the multi resonance chip antenna.

As described, the above mounting configurations of the chip antenna can achieve reduction in size, length and thickness of an electronic device in which it is built, while also reducing the value of SAR, an effect of the electromagnetic radiation.

Fourth Exemplary Embodiment

In the fourth exemplary embodiment, description is provided of examples of electronic devices equipped with chip antennas.

Figure 39:
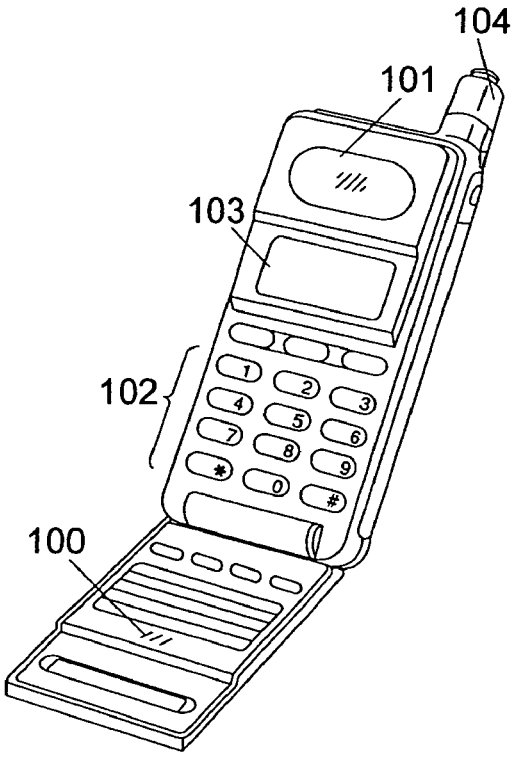
FIG. 39 is a perspective view of a portable terminal according to a fourth exemplary embodiment of this invention.
Figure 40:
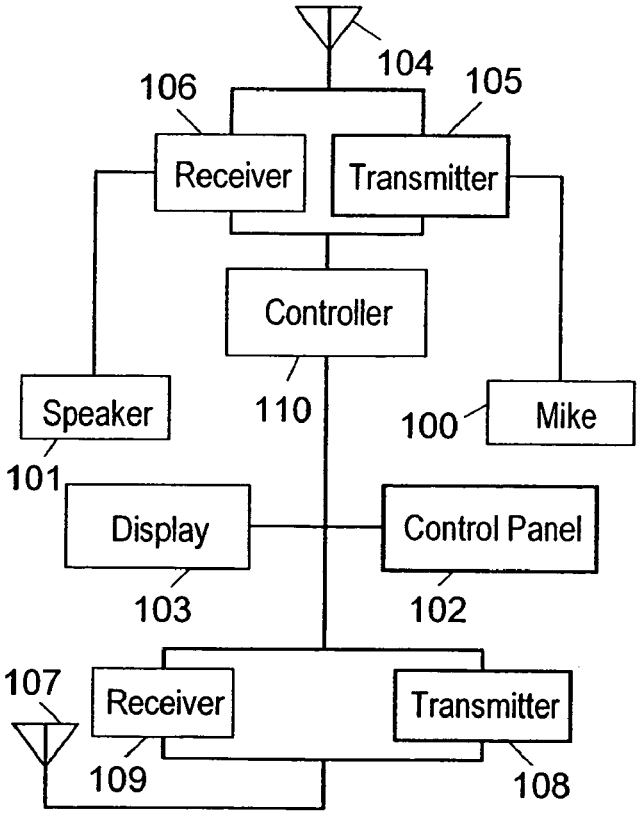
FIG. 40 is a block diagram showing an operating process of the portable terminal according to the fourth exemplary embodiment of this invention.
Figure 41:
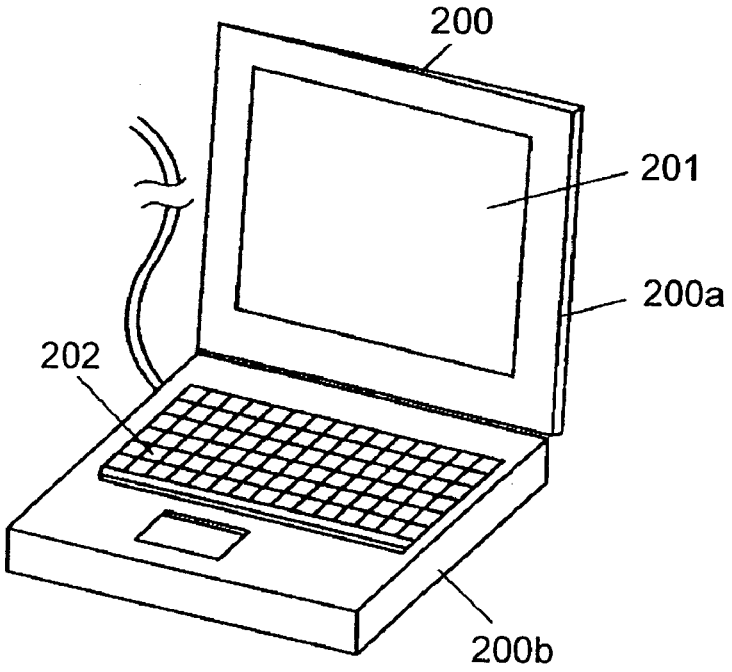
FIG. 41 is a perspective view of a notebook type computer according to the fourth exemplary embodiment of this invention.
Figure 42:
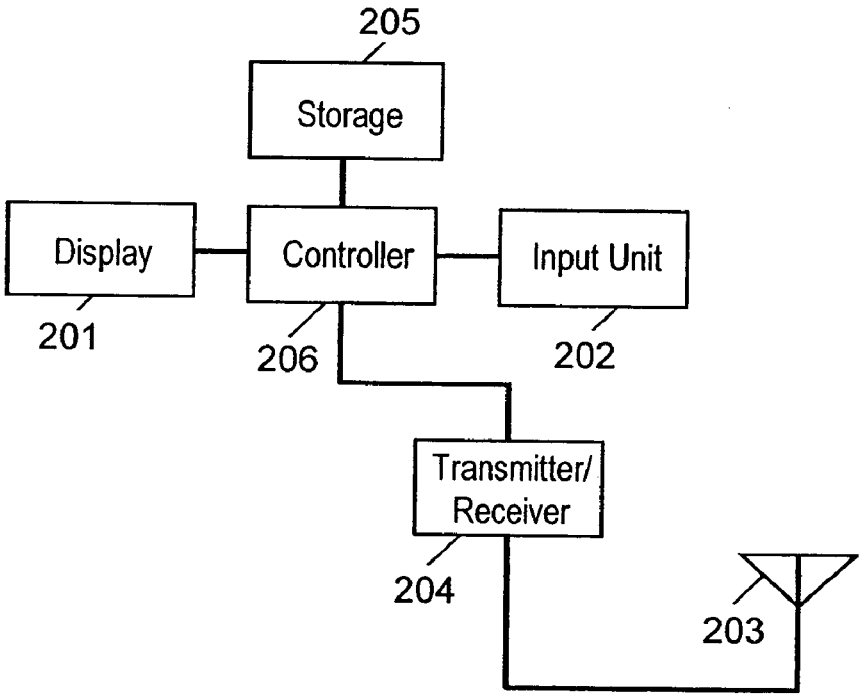
FIG. 42 is a block diagram showing an operating process of the notebook type computer according to the fourth exemplary embodiment of this invention.

FIG. 39 is a perspective view of a portable terminal according to the fourth exemplary embodiment, FIG. 40 a block diagram showing a process in the portable terminal according to the fourth exemplary embodiment, FIG. 41 a perspective view of a notebook type computer according to the fourth exemplary embodiment, and FIG. 42 a block diagram showing a process in the notebook type computer according to the fourth exemplary embodiment.

In FIG. 39 and FIG. 40, the portable terminal comprises microphone 100 for converting voice into audio signals, speaker 101 for converting audio signals into sound, control panel 102 having dial buttons and the like, display 103 for displaying arrival of an incoming call and the like, antenna 104 for exchanging electromagnetic waves with a base station connected with the public network and the like, and transmitter 105 for modulating the audio signals from microphone 100 and converting them into transmission signals, wherein the transmission signals produced in transmitter 105 are radiated from antenna 104 to the outside. Receiver 106 converts signals received through antenna 104 into audio signals, which, in turn, are converted by speaker 101 into audible sound. Antenna 107 performs transmission and reception of electromagnetic waves with at least one of another portable terminal device, such as a desktop computer and a mobile computer, a wireless LAN system, and a base station, although not shown in these figures, and it employs one of the chip antennas shown in FIG. 1, FIG. 8, and the like. Transmitter 108 converts data signals into data transmission signals, and transmits the data transmission signals through antenna 107. Receiver 109 converts data reception signals received through antenna 107 into data signals. Controller 110 controls transmitter 105, receiver 106, control panel 102, display 103, transmitter 108 and receiver 109.

Antenna 107 is generally stored inside of an enclosure of the portable terminal. A whip antenna, for instance, is suitably used as antenna 104. Antenna 104 is used normally as an antenna for telephone communications, and antenna 107 is used for providing data communications with other systems and other equipment, such as wireless LAN communications and data communications.

In this fourth exemplary embodiment, although antenna 104 is provided for telephone communications, this antenna 104 and the associating receiver 106 and transmitter 105 may be omitted. Transmission and reception of electromagnetic waves for the telephone communications, as well as the data communications, can be made with antenna 107, since it is capable of resonating with a plurality of frequencies.

Furthermore, one transmitting and receiving capability of antenna 107 may be used as a diversity antenna for telephone communications, and others for GPS and data communications.

Use of the chip antenna of multi resonance type as antenna 107 can simplify and downsize the built-in antenna structure in this manner, and it can also reduce size of the portable terminal. Since the chip antenna is also adaptable to a plurality of frequencies, it allows a single unit of a portable terminal to perform wireless communications with a variety of frequencies.

Description is provided hereinafter of an example of operation of the mobile telecommunications devices shown in FIG. 39 and FIG. 40.

When there is an incoming call, receiver 106 sends a call arrival signal to controller 110, and controller 110 displays predetermined characters and the like on display 103 according to the call arrival signal. When a user pushes a button or the like on control panel 102 to indicate the intent of receiving the call, a signal is sent to controller 110, which in turn sets the relevant components to a call receiving mode. This means that the signals received with antenna 104 are converted into audio signals in receiver 106 and the audio signals are output as audible voice from speaker 101, and voice messages input from microphone 100 are converted into audio signals and transmitted to the outside from antenna 104 through transmitter 105. Describing next is an example of making a call. When a call is made, a signal signifying an initiation of the call is input first from control panel 102 to controller 110.

Subsequently, when a signal corresponding to a telephone number is sent from control panel 102 to controller 110, controller 110 transmits the signal of the telephone number through transmitter 105 and antenna 104. Upon establishment of a communication path in response to the transmitted signal, another signal to that effect is sent to controller 110 through antenna 104 and receiver 106, and controller 110 sets the individual components to a call transmitting mode. This means the signals received with antenna 104 are converted into audio signals in receiver 106 and the audio signals are output as audible voice from speaker 101, and voice messages input from microphone 100 are converted into audio signals and transmitted to the outside from antenna 104 through transmitter 105.

In the case of data communications, data to be transmitted are converted in transmitter 108 into signals of predetermined form, and transmitted through antenna 107 to other systems, other electronic devices and the like. Signals transmitted from other systems, other electronic devices and the like are input to antenna 107, and converted by receiver 109 into data of the predetermined form, which is directly input to display 103 to display images and the like, in some cases. In the other cases, the data are processed by controller 110 for conversion into a predetermined form, to display images in display 103 or produce certain sound from speaker 101.

There are a plurality of standards with a plurality of frequencies for portable terminals, such as 900 MHz band in the GSM system, 1,800 MHz band in the GSM-1800, 1,900 MHz bands in the PCS system, and the like. Chip antennas, such as the one discussed in the first exemplary embodiment, are quite useful to realize portable terminals of the above kind.

Description is provided next of an example of a chip antenna applied to a notebook type computer.

In FIG. 41 and FIG. 42, notebook type computer 200 comprises enclosure case 200*a*, housing display part 201 and another enclosure case 200*b* housing input unit 202. Enclosure case 200*a* and enclosure case 200*b* are connected with a hinge or the like. Although notebook type computer 200 is given in this example, this fourth exemplary embodiment is suitable for other mobile devices and network devices, such as electronic notebooks.

Notebook type computer 200 is provided therein with chip antenna 203. Any mountable chip antenna, such as those shown in FIG. 1 through FIG. 9 is suitable for use as antenna 203, and chip antenna 203 is built into at least one of enclosure cases 200*a* and 200*b*. It is desirable to mount the chip antenna 203 to an upper part of enclosure case 200*a* so that the chip antenna 203 is located at a relatively high position to demonstrate good transmitting and receiving performance when enclosure cases 200*a* and 200*b* are opened. Transmitter receiver 204 converts reception signals received in antenna 201*a* into reception data signals, and transmission data to be transmitted into transmission signals. Input unit 202 comprises any of a keyboard, a penpad, a voice input device and the like, and input unit 202 receives an input to be transmitted to the outside. Display 201 displays data, such as those transmitted from the outside and input from input unit 202. An LCD display, a CRT display, an organic EL display, a plasma display, and the like are suitable for use as display 201. Storage 205 stores transmitted data and the like. A hard disk drive, a flexible disk drive, an optical disk drive such as a DVD drive, a magneto-optical disk drive, a CD-R drive and a CD-RW drive capable of storing and retrieving data are suitable for use as storage 205. Controller 206 controls individual components.

Description is provided of an example of operation of notebook type computer 200 constructed as above, when used for a wireless LAN system.

There are some wireless LAN systems that transmit and receive data using different frequency for each system. Use of a chip antenna in the above manner can, thus, make notebook type computer 200 capable of accessing a plurality of systems with only the single antenna, thereby achieving a reduction in size of notebook type computer 200.

When antenna 203 receives electromagnetic waves transmitted from an antenna of the wireless LAN system, transmitter receiver 204 converts signals corresponding to the electromagnetic waves into signals of a predetermined form, and controller 206 sends the signals as they are or after having been processed to storage 205 for storing or to display 201 for displaying a predetermined image. When data input from input unit 202 or data stored in storage 205 is transmitted to the wireless LAN system, controller 206 send to transmitter receiver 204 the data as they are or after having been processed into a predetermined form, and transmitter receiver 204 converts the data into signals and transmits them as electromagnetic waves from antenna 203 to the wireless LAN system.

The wireless LAN system mainly uses 2.4 GHz band and 5 GHz band, and any of the chip antennas discussed in the first exemplary embodiment is very useful.

Accordingly, this invention allows a single unit of a portable terminal and the like to perform wireless communications using a plurality of different frequencies by constructing the portable terminal with the chip antenna capable of transmitting and receiving the plurality of frequencies, thereby realizing the multi terminal and the like very easily.

Fifth Exemplary Embodiment

In the fifth exemplary embodiment, description is provided of a manufacturing process of the chip antenna.

Figure 43:
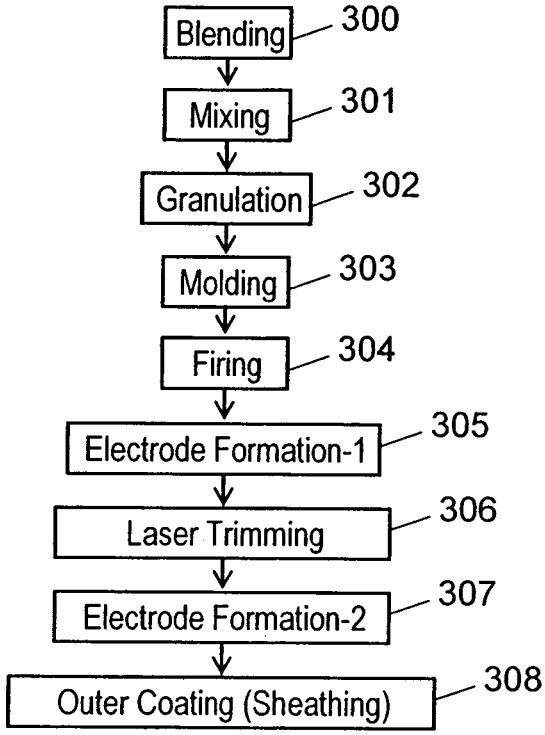
FIG. 43 is a flow chart showing a manufacturing process according to a fifth exemplary embodiment of this invention.
Figure 44:
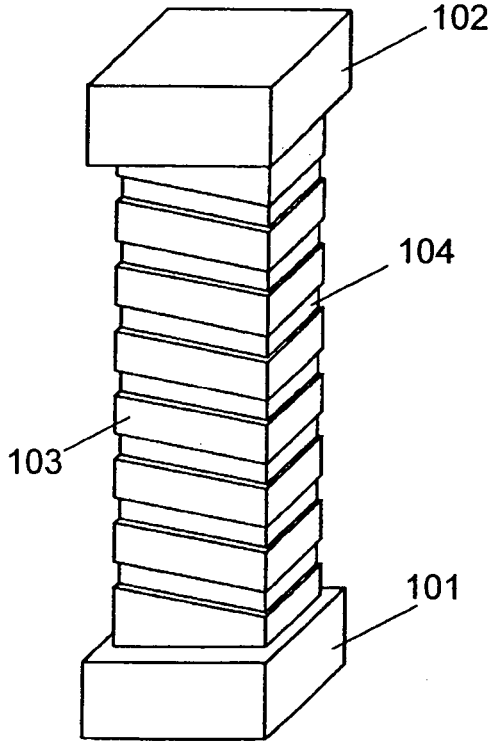
FIG. 44 is a perspective view of a chip antenna of the prior art.
Figure 45:
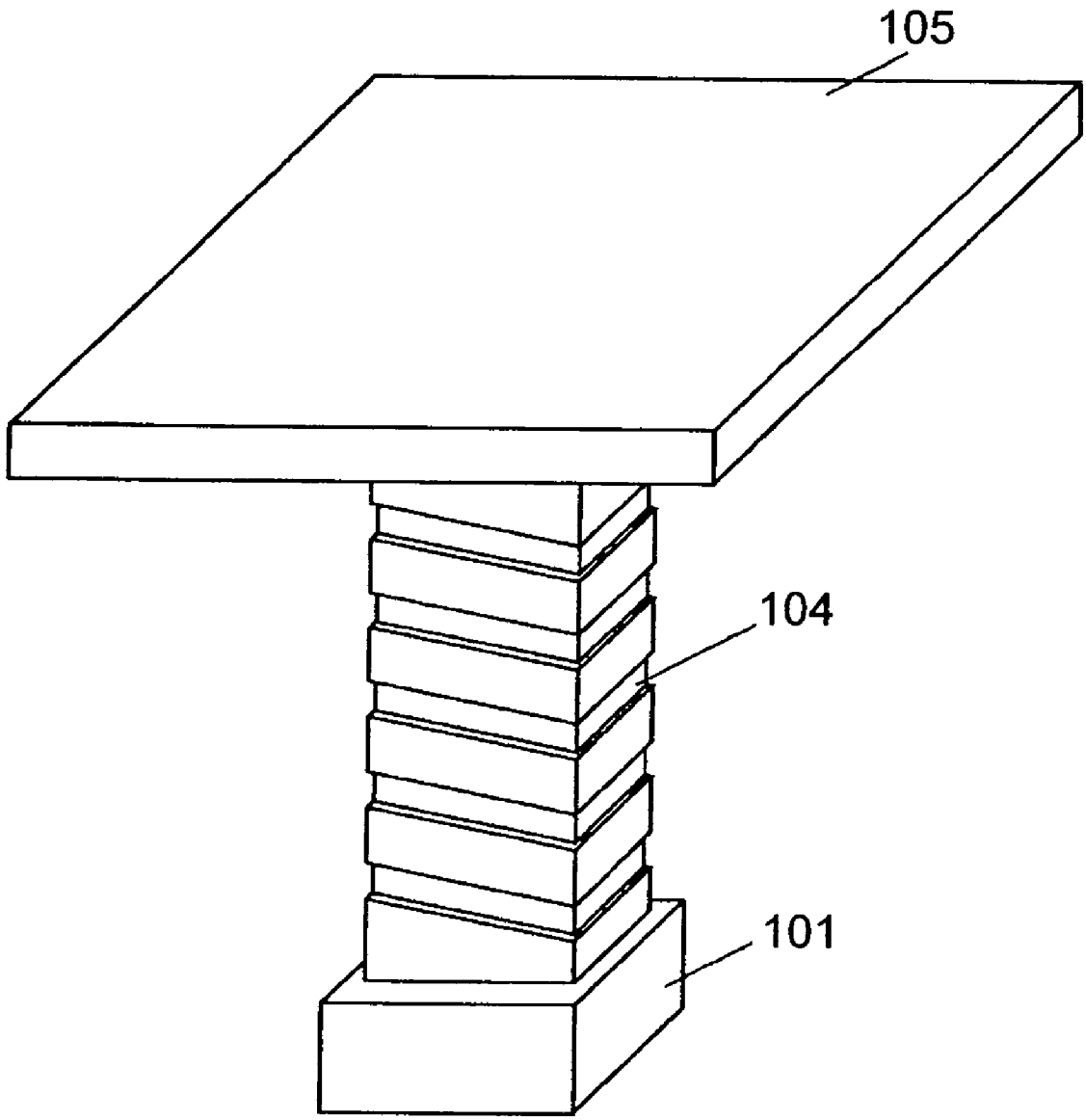
FIG. 45 is a perspective view of another chip antenna of the prior art.

FIG. 43 is a flow chart showing the manufacturing process of the chip antenna according to the fifth exemplary embodiment.

The manufacturing process comprises blending process 300, mixing process 301, granulation process 302, molding process 303, firing process 304, first electrode formation process 305, laser trimming process 306, second electrode formation process 307 and outer coating process 308.

First, a ceramic material having a principal ingredient of alumina is blended. Other than the principal ingredient of alumina, forsterite, zirconia, tin, titanate base material, magnesium titanate base material, calcium titanate base material, barium titanate base material, and the like are blended as needed. One example of the blended composition used here consists of 92 wt-% or more of $Al_2O_3$, 6 wt-% or less of $SiO_2$, 1.5 wt-% or less of MgO, 0.1 wt-% or less of $Fe_2O_3$, and 0.3 wt-% or less of $Na_2O$. There are always a certain amount of impurities which are unavoidable as a matter of course. Individual ingredients are weighed and blended.

The blended ingredients are stirred in a mixing furnace or the like until they are mixed thoroughly.

The mixed material undergoes a granulation process 302, and granular size is adjusted in order to make it a desired diameter. Granulation process 302 for producing the optimum granular diameter is necessary, since it gives rise to a problem of deficient strength and the like, if the granular diameter is too large.

The mixed material having the particle size adjusted in granulation process 302 is molded into a desired shape in molding process 303. In the molding process, the material is put into a molding die or the like tooling having the desired shape, and a pressure of 2 to 5 tons is applied. The shape of molding includes a configuration and dimensions suitable for the substrate.

The molded element body is fired in firing process 304 to secure the necessary strength. It is desirable to use a firing temperature of approximately 1,500 to 1,600 degrees-C., and a firing period of approximately 1 to 3 hours. The firing temperature and the firing period can vary depending upon kind of the material used, size and shape of the element body.

A conductive film is formed on a surface of the fired substrate in first electrode formation process 305. The film may be formed of copper, for instance, by such a method as electroless plating, vapor deposition and sputtering. Other materials such as gold, platinum, palladium, silver, tungsten, titanium, nickel, and tin are used to form the film by the method of electroless plating, vapor deposition or sputtering.

After the conductive film is formed in first electrode formation process 305, a helical conductor is formed by trimming a spiral slit in laser trimming process 306. A YAG laser, $CO_2$ laser and excimer laser are some of examples of lasers used for the laser trimming. The trimmed slit is formed by irradiating a laser beam to the conductive film on the substrate held in a rotary support.

In second electrode formation process 307, an outer conductive layer is formed over the substrate having the helical conductor formed in the laser trimming process 306. The outer conductive layer is formed of copper, nickel, tin or the like material by electrolysis plating. The electrolysis-plated layer is not formed in the trimmed slit because there is no electroless-plated film in the trimmed slit. In second electrode formation process 307, the new conductive layer is formed only on a surface area other than the trimmed slit. The additional layer gives an advantage of improving conductivity and strength against impact of the conductive film after it is mounted.

Finally, a protective film is formed in outer coating process 308 to complete the manufacturing of the chip antenna. The protective film may be formed with any of tube-like film, paste-like film, electro-deposited film and the like, as described in the first exemplary embodiment.

What is claimed is:

1. A chip antenna comprising:

a substrate having a pair of end portions;

a plurality of helical conductors provided on said substrate; and a pair of terminals respectively provided on said pair of end portions of said substrate, wherein one of said plurality of helical conductors is electrically connected to one of said pair of terminals, and another of said plurality of helical conductors is electrically connected to another of said pair of terminals, wherein said plurality of helical conductors are not electrically conductive with respect to each other, wherein said plurality of helical conductors are capacitively coupled, and wherein said one of said pair of terminals is connected to a power feeding section for feeding a signal current to said one of said pair of terminals and said another of said pair of terminals is open ended.

2. The chip antenna according to claim 1, wherein said plurality of helical conductors and said pair of terminals are formed by a same conductive film.

3. The chip antenna according to claim 1, wherein said one of said plurality of helical conductors corresponds to a highest frequency of a plurality of transmitting and receiving frequencies and is connected to said one of said pair of terminals connected to the power feeding section.

4. The chip antenna according to claim 1, wherein a portion of said substrate has a smaller cross sectional area than portions of said substrate on which said pair of terminals are provided.

5. The chip antenna according to claim 1, wherein said substrate comprises one of a quadrangular prism, a circular cylinder, a triangular prism, and an elliptic cylinder.

6. The chip antenna according to claim 1, wherein said substrate comprises one of a circular cylinder and an elliptic cylinder, and portions of said substrate on which said pair of terminals are located are cubical in shape.

7. The chip antenna according to claim 5, wherein said substrate is rectangular in cross section and has a longer dimension in a lateral direction than a dimension in a vertical direction.

8. The chip antenna according to claim 1, wherein a portion of said substrate has a larger cross sectional area than another portion of said substrate.

9. The chip antenna according to claim 8, wherein said portion having the larger cross sectional area is not provided with any of said plurality of helical conductors.

10. The chip antenna according to claim 1, further comprising a protective film covering at least said plurality of helical conductors on said substrate.

11. The chip antenna according to claim 10, wherein said protective film comprises one of a tube-like protective film, a coated protective film, and an electro-deposited film.

12. The chip antenna according to claim 1, wherein said plurality of helical conductors are formed by one of trimming said substrate which is covered with a conductive film and winding a wire around said substrate.

13. The chip antenna according to claim 1, wherein said chip antenna is operable to transmit and receive frequencies of at least a GSM band and a DCS-1800 telecommunication band.

14. The chip antenna according to claim 1, wherein said chip antenna has a length L, a height H and a width W of:

$4.0\ \text{mm} \leqq L \leqq 40.0\ \text{mm}$;

$0.5\ \text{mm} \leqq H \leqq 10.0\ \text{mm}$; and $0.5\ \text{mm} \leqq W \leqq 10.0\ \text{mm}$.

15. The chip antenna according to claim 1, further comprising a crown conductor electrically connected to said another of said pair of terminals that is open ended.

16. The chip antenna according to claim 15, wherein a portion of said substrate has a larger cross sectional area than another portion of said substrate, said crown conductor is also connected to said portion of said substrate having the larger cross sectional area, and wherein said portion having the larger cross sectional area does not include a portion provided with said plurality of helical conductors.

17. The chip antenna according to claim 15, wherein said crown conductor has one of a generally triangular shape, a generally square shape, a generally polygonal shape, a generally circular shape and a generally oval shape.

18. An antenna device comprising the chip antenna according to claim 1, wherein the chip antenna is mounted to a location in a portable terminal, the location being at a lower portion of the portable terminal when the portable terminal is in normal use orientation.

19. A chip antenna comprising:

a substrate having a pair of end portions;

a plurality of helical conductors provided on said substrate; and a pair of terminals respectively provided on said pair of end portions of said substrate, wherein one of said plurality of helical conductors is electrically connected to one of said pair of terminals, and another of said plurality of helical conductors is electrically connected to another of said pair of terminals, wherein said plurality of helical conductors are electrically connected with each other, wherein said one of said pair of terminals is connected to a power feeding section for feeding a signal current to said one of said pair of terminals and said another of said pair of terminals is open ended, wherein said one of said plurality of helical conductors corresponds to a highest frequency of a plurality of transmitting and receiving frequencies and is connected to said one of said pair of terminals connected to the power feeding section, and wherein said plurality of helical conductors is at least three of said helical conductors.

20. An antenna device comprising the chip antenna according to claim 19, wherein the chip antenna is mounted to a location in a portable terminal, the location being at a lower portion of the portable terminal when the portable terminal is in normal use orientation.

* * * * *